US009528332B2

(12) United States Patent
Richardson

(10) Patent No.: US 9,528,332 B2
(45) **Date of Patent: *Dec. 27, 2016**

(54) POWER TONG

(71) Applicant: Allan Stewart Richardson, The Woodlands, TX (US)

(72) Inventor: Allan Stewart Richardson, The Woodlands, TX (US)

(73) Assignee: Warrior Energy Technologies Limited, Calgary, Alberta (CA)

( * ) Notice: Subject to any disclaimer, the term of this patent is extended or adjusted under 35 U.S.C. 154(b) by 280 days.

This patent is subject to a terminal disclaimer.

(21) Appl. No.: 14/296,941

(22) Filed: Jun. 5, 2014

(65) Prior Publication Data

US 2014/0283653 A1 Sep. 25, 2014

Related U.S. Application Data

(63) Continuation of application No. 13/367,305, filed on Feb. 6, 2012, now Pat. No. 8,863,621, which is a continuation-in-part of application No. 12/379,090, filed on Feb. 12, 2009, now Pat. No. 8,109,179.

(60) Provisional application No. 61/071,170, filed on Apr. 16, 2008, provisional application No. 61/064,032, filed on Feb. 12, 2008.

(51) Int. Cl.
*E21B 19/16* (2006.01)

(52) U.S. Cl.
CPC ..... *E21B 19/164* (2013.01)

(58) Field of Classification Search
CPC ..... E21B 19/161; E21B 19/164
USPC ..... 81/57.11, 57.16, 57.22, 57.34
See application file for complete search history.

(56) References Cited

U.S. PATENT DOCUMENTS

| | | | | |
|---|---|---|---|---|
| 4,194,419 | A | 3/1980 | Mitchhart et al. | |
| 4,274,778 | A | 6/1981 | Putnam et al. | |
| 4,512,216 | A * | 4/1985 | Callegari, Sr. | E21B 19/168 81/57.17 |
| 4,694,712 | A * | 9/1987 | Doss | E21B 19/168 81/57.14 |
| 4,765,401 | A | 8/1988 | Boyadjieff | |
| 4,979,356 | A | 12/1990 | Vatne | |
| 5,167,173 | A | 12/1992 | Pietras | |
| 6,082,225 | A | 7/2000 | Richardson | |
| 6,752,044 | B2 | 6/2004 | Hawkins, III | |
| 6,776,070 | B1 | 8/2004 | Matson et al. | |
| 7,000,502 | B2 | 2/2006 | Belik | |

(Continued)

*Primary Examiner* — Hadi Shakeri
(74) *Attorney, Agent, or Firm* — Oyen Wiggs Green & Mutala LLP

(57) ABSTRACT

A power tong includes a rotor, driven by a primary drive, for spinning and torquing threaded connections of a tubular gripped in the rotor. A grip in the rotor grips the tubular. A serpentine member supplies power to actuate the grip. The serpentine member is driven by a secondary drive. The primary and secondary drives are mounted on a stator frame. The rotor is rotatably mounted to the stator frame and driven by the primary drive during continuous three hundred and sixty degrees of rotation. A fixed or backup jaw may also be mounted to the stator frame. Tubular grippers on the fixed jaw grip a first side of a tubular joint. The grip on the rotor grips the opposite side of the tubular joint. High torque low-rotational speed applied to the rotor torques the joint. Low torque high-rotational speed applied to the rotor spins the joint.

25 Claims, 24 Drawing Sheets

(56) References Cited

U.S. PATENT DOCUMENTS

| | | | | |
|---|---|---|---|---|
| 7,313,986 | B2 | 1/2008 | West et al. | |
| 7,437,974 | B2 | 10/2008 | Slettedal et al. | |
| 7,685,910 | B2 * | 3/2010 | Kennedy ..... | E21B 19/163 81/57.15 |
| 2008/0282847 | A1 | 11/2008 | Halse | |
| 2009/0211404 | A1 | 8/2009 | Pedersen et al. | |
| 2009/0314137 | A1 | 12/2009 | Perez | |

* cited by examiner

OPERATING POSITION

PARKED POSITION

POWER TONG

CROSS REFERENCE TO RELATED APPLICATIONS

This is a continuation of application Ser. No. 13/367,305, filed Feb. 6, 2012, now U.S. Pat. No. 8,863,621, which is a continuation-in-part of application Ser. No. 12/379,090, filed Feb. 12, 2009, now U.S. Pat. No. 8,109,179, which claims the benefit of U.S. Provisional Application No. 61/071,170, filed Apr. 16, 2008 and U.S. Provisional Application No. 61/064,032, filed Feb. 12, 2008.

FIELD OF THE INVENTION

This invention relates to the field of devices for rotating tubular members so as to make up or break out threaded joints between tubulars including casing, drill pipe, drill collars and tubing (herein referred to collectively as pipe or tubulars), and in particular to a power tong for the improved handling and efficient automation of such activity.

BACKGROUND OF THE INVENTION

In applicant's experience, on conventional rotary rigs, helpers, otherwise known as roughnecks, handle the lower end of the pipe when they are tripping it in or out of the hole. As used herein, the terms pipe and tubular are used interchangeably. The roughnecks also use large wrenches commonly referred to as tongs to screw or unscrew, that is make up or break out pipe. Applicant is aware that there are some other tongs that are so called power tongs, torque wrenches, or iron roughnecks which replace the conventional tongs. The use of prior art conventional tongs is illustrated in FIG. 1*a*. Other tongs are described in the following prior art descriptions.

In the prior art applicant is aware of U.S. Pat. No. 6,082,225 which issued Feb. 17, 1997 to Richardson for a Power Tong Wrench. Richardson describes a power tong wrench having an open slot to accommodate a range of pipe diameters capable of making and breaking pipe threads and spinning in or out the threads and in which hydraulic power is supplied with a pump disposed within a rotary assembly. The pump is powered through a non-mechanical coupling, taught to be a motor disposed outside the rotary assembly.

In the present invention the rotary hydraulic and electrical systems are powered at all times and in all rotary positions via a serpentine such as a serpentine belt drive, unlike in the Richardson patent in which they are powered only in the home position. In the present invention the pipe can thus be gripped and ungripped repeatedly in any rotary position with no dependence on stored energy and the tong according to the present invention may be more compact because of reduced hydraulic accumulator requirements for energy storage wherein hydraulic accumulators are used for energy storage only to enhance gripping speed.

Applicant is also aware of U.S. Pat. No. 5,167,173 which issued Dec. 1, 1992 to Pietras for a Tong. Pietras describes that tongs are used in the drilling industry for gripping and rotating pipes, Pietras stating that generally pipes are gripped between one or more passive jaws and one or more active jaws which are urged against the pipe. He states that normally the radial position of the jaws is fixed and consequently these jaws and/or their jaw holders must be changed to accommodate pipes of different diameters.

Applicant is also aware of U.S. Pat. No. 6,776,070 which issued Aug. 17, 2004 to Mason et al. for an Iron Roughneck.

Mason et al. describes an iron roughneck as including a pair of upper jaws carrying pipe gripping dies for gripping tool joints where the jaws have recesses formed on each side of the pipe gripping dies to receive spinning rollers. By positioning the spinning rollers in the upper jaws at the same level as the pipe gripping dies the spinning rollers are able to engage the pipe closer to the lower jaws and thus can act on the tool joint rather than on the pipe stem. Mason et al. describe that in running a string of drill pipe or other pipe into or out of a well, a combination torque wrench and spinning wrench are often used, referred to as "iron roughnecks". These devices combine torque and spinning wrenches as for example described in U.S. Pat. Nos. 4,023,449, 4,348,920, and 4,765,401, to Boyadjieff.

In the prior art iron roughnecks, spinning wrenches and torque wrenches are commonly mounted together on a single carriage but are, nevertheless, separate machines with the exception of the Iron Roughnecks of Mason which combines the spinner wrench rollers and torque jaws in a common holder, although they nevertheless, still work independently of each other. When breaking-out, or loosening, connections between two joints of drill pipe, the upper jaw of the torque wrench is used to clamp onto the end portion of an upper joint of pipe, and the lower jaw of the torque wrench clamps onto the end portion of the lower joint of pipe.

Drill pipe manufacturers add threaded components, called "tool joints", to each end of a joint of drill pipe. They add the threaded tool joints because the metal wall of drill pipe is not thick enough for threads to be cut into them. The tool joints are welded over the end portions of the drill pipe and give the pipe a characteristic bulge at each end. One tool joint, having female, or inside threads, is called a "box". The tool joint on the other end has male, or outside threads, and is called the "pin". Disconnection of the pin from the box requires both a high-torque and low angular displacement 'break' action to disengage the contact shoulders and a low-torque high-angular displacement 'spin' action to screw out the threads. Connection of the pin and box require the reverse sequence. In the make/break action torque is high (10,000-100,000 ft-lb), having a small (30-60 degrees) angular displacement. In the spin action torque is low (1,000-3,000 ft-lb), having a large (3-5 revolutions) angular displacement.

After clamping onto the tool joints, the upper and lower jaws are turned relative to each other to break the connection between the upper and lower tool joints. The upper jaw is then released while the lower jaw (also referred to as a back-up jaw) remains clamped onto the lower tool joint. A spinning wrench, which is commonly separate from the torque wrench and mounted higher up on the carriage, engages the stem of the upper joint of drill pipe and spins the upper joint of drill pipe until it is disconnected from the lower joint. When making up (connecting) two joints of pipe the lower jaw grips the lower tool joint, the upper pipe is brought into position, the spinning wrench (or in some cases a top drive) engages the upper joint and spins it in. The torque wrench upper jaws clamp the pipe and tightens the connection.

Applicant is further aware of United States Published patent application entitled Power Tong, which was published Apr. 5, 2007 under Publication No. US 2007/0074606 for the application of Halse. Halse discloses a power tong which includes a drive ring and at least one clamping device with the clamping devices arranged to grip a pipe string. A driving mechanism is provided for rotation of the clamping device about the longitudinal axis of the pipe string. The clamping device communicates with a fluid supply via a swivel ring that encircles the drive ring of the driving mechanism. Thus Halse provides for three hundred sixty degree continuous rotation combining a spinner with a torque tong. The Halse power tong does not include a radial opening, the tong having a swivel coupling surrounding the tong for transferring pressurized fluid from an external source to the tong when the tong rotates about the axis of the pipe. Halse states that having a radial opening in a power tong complicates the design of the power tong and weakens the structure surrounding the pipe considerably, stating that as a result, the structure must be up-rated in order to accommodate the relatively large forces being transferred between the power tong and the pipe string. Halse further opines that a relatively complicated mechanical device is required to close the radial opening when the power tong is in use, and in many cases also to transfer forces between the sides of the opening. The Halse tong is not desirable for drilling operations because there is no throat opening to allow the tong to be positioned around the pipe at the operator's discretion. The pipe must always pass through the tong.

SUMMARY OF THE INVENTION

The power tong according to the present invention continuously rotates tubulars for spinning and torquing threaded connections. Continuous rotation is achieved through a rotating jaw (also referred to as a rotor) that has grippers that grip the tubular. Hydraulic and electrical power necessary for actuating the grippers is generated on board the rotor since the continuous rotation does not allow for either hydraulic or electrical external connections. A serpentine member such as a serpentine drive belt system turns the motors of an on-board hydraulic power unit and electric generators which may be AC or DC generators, to supply the grippers with the necessary hydraulic and electrical power.

The present invention includes a rotor rotably mounted in or on a rigid structural framework or stator frame. A main drive drives the rotor. The rotor may be supported and held in position by the use of opposed helical pinions/gears which support the rotor vertically and guide bushings which locate it laterally and support it vertically when the torque is low. The grippers, which may be actuated by hydraulic gripper cylinders, maybe held in position by links and guide bushings that can withstand the torque parameters of the tong. The gripper cylinders may be moved in a range of travel by an eccentric. This provides for a tong that can accommodate a large range of pipe diameters (3.5 inch drillpipe to 9-⅝ inch casing or larger). A centralizing linkage ensures that the pipe is gripped concentricly with the tong axis of rotation. The tong does not require a mechanical device to close the radial opening. The on-board power source and rotary control system allow the present invention to have fully independently activated and controlled rotary gripping of the tubular. It is capable of high torque for making and breaking and high speed for spinning, all within one mechanism. One embodiment of the present invention also overcomes the limitation of the spinning wrench engaging the stem area of the drillpipe which over time will cause fatigue in the stem area as the spinning and torquing according to the present invention is accomplished with the same jaw that engages the pipe on the tool joint. The throat of the jaws according to the present invention has an opening of sufficient diameter to accept a tubular. The throat cooperates with the opening to allow the power tong to be selectively positioned around the pipe at the operators' discretion.

DETAILED DESCRIPTION OF EMBODIMENTS OF THE INVENTION

Figure 1:
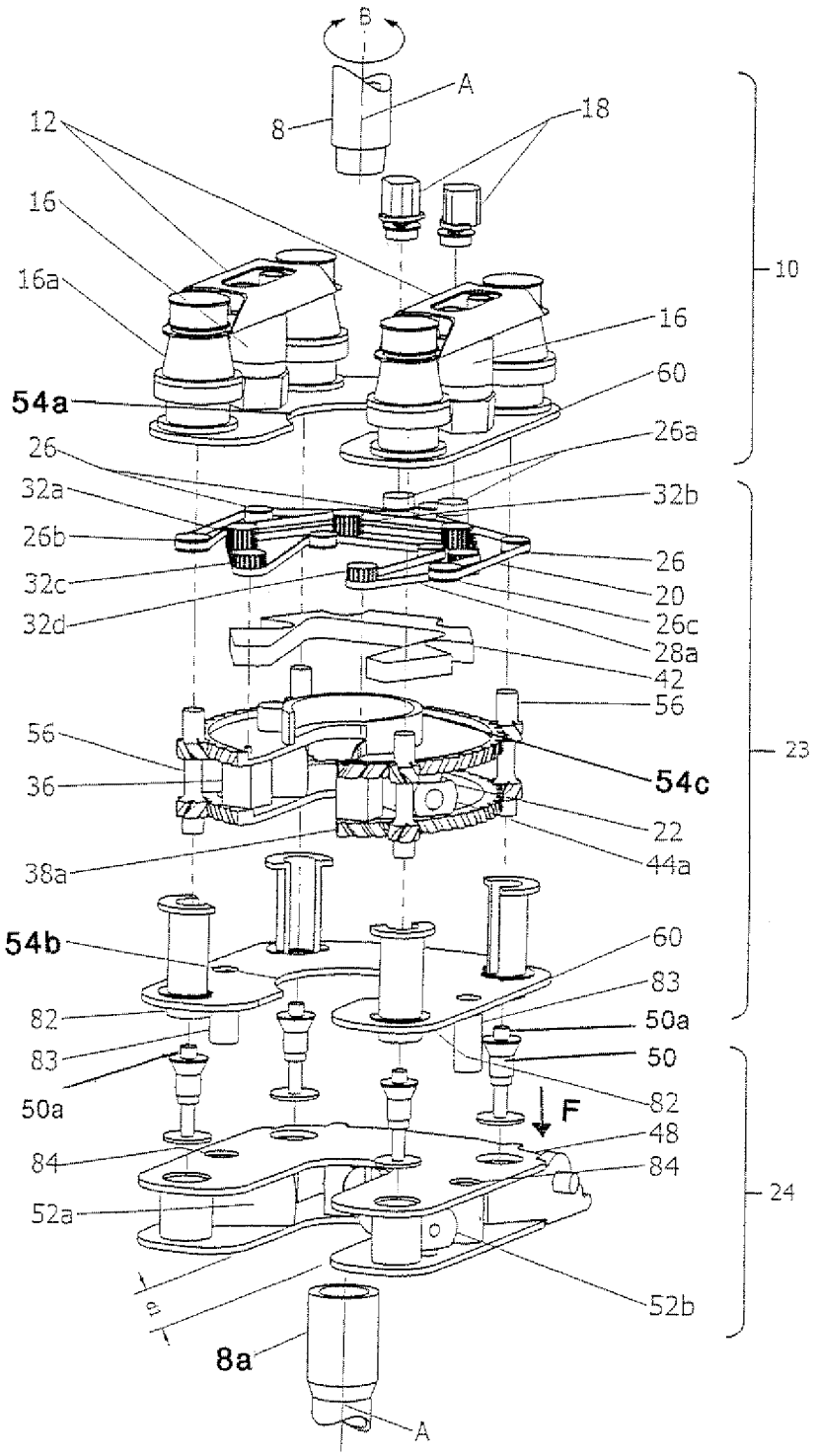
FIG. 1 is, in exploded perspective view, the power tong according to one embodiment of the present invention.
Figure 1A:
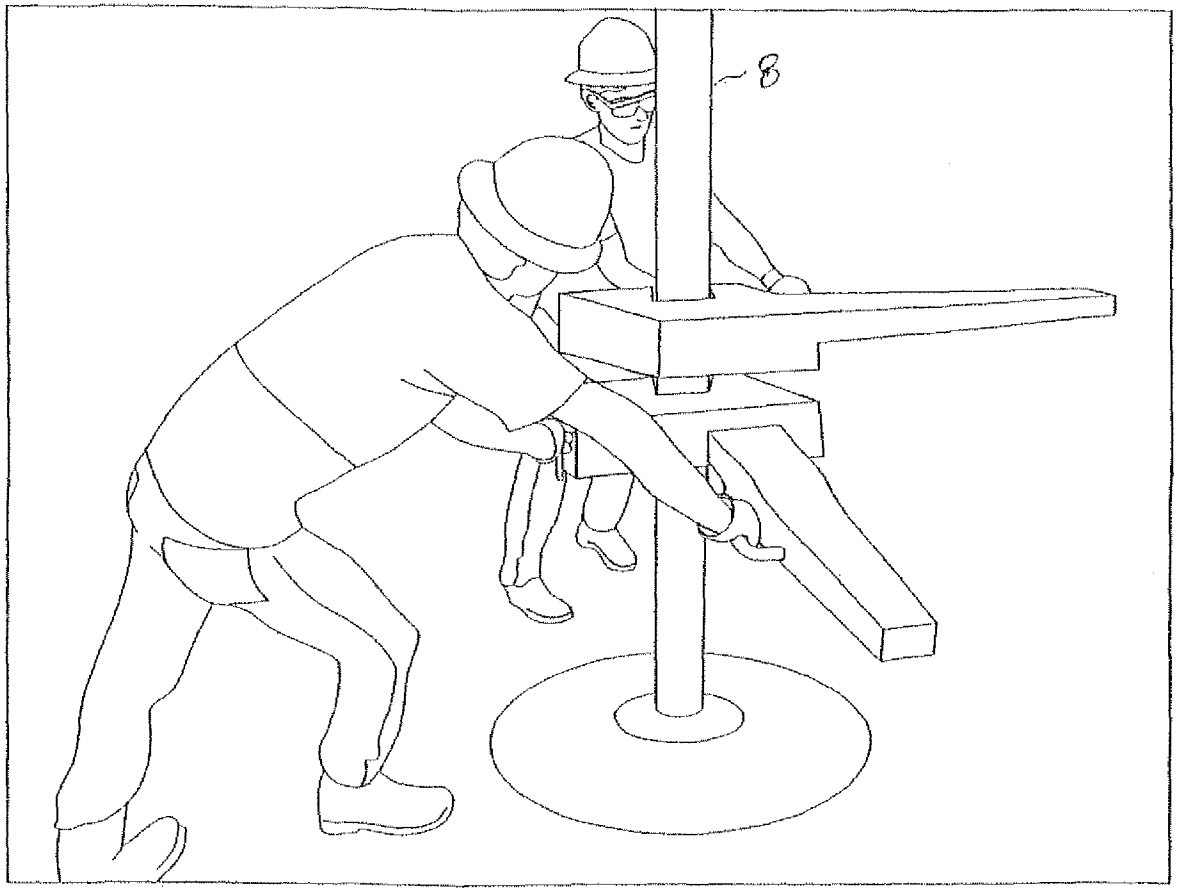
FIG. 1a PRIOR ART
FIG. 1*a* is a depiction of the use of prior art conventional tongs.
Figure 1B:
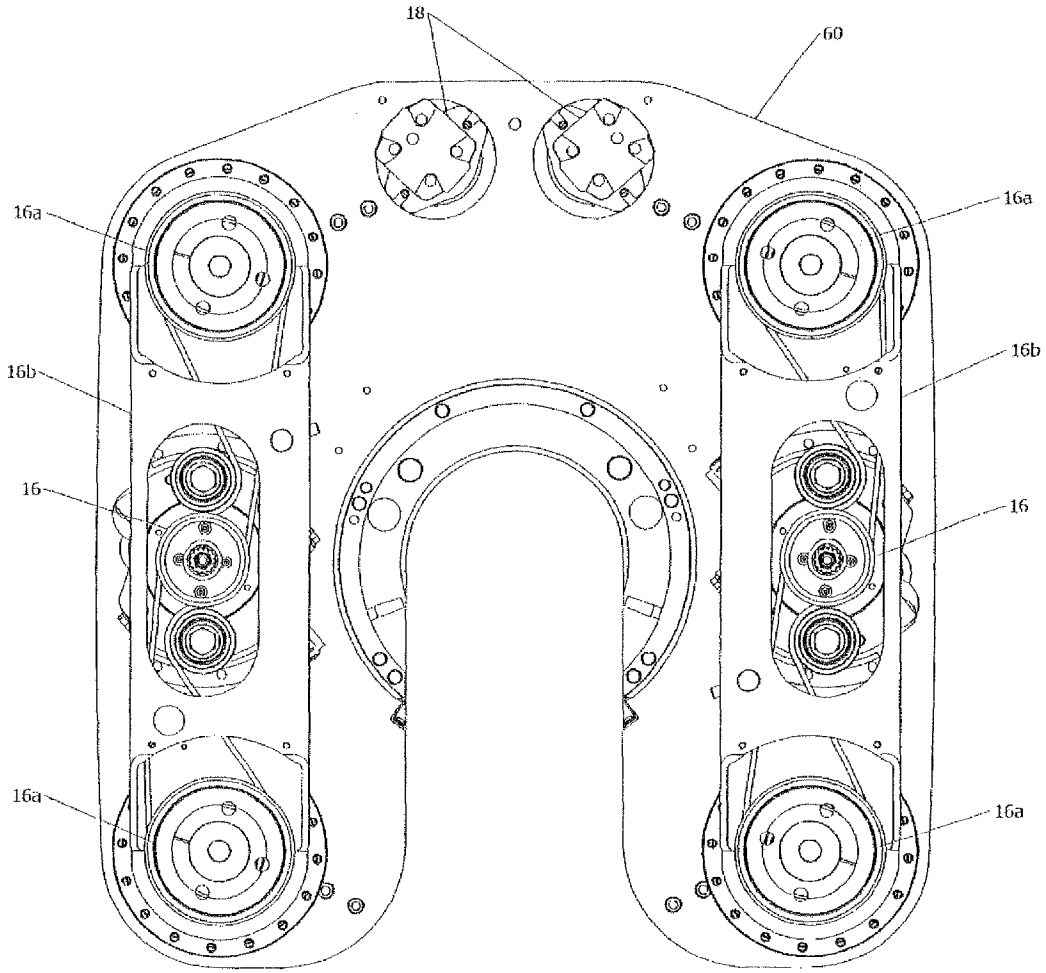
FIG. 1*b* is a top view of the drive section of the power tong of FIG. 1.
Figure 2:
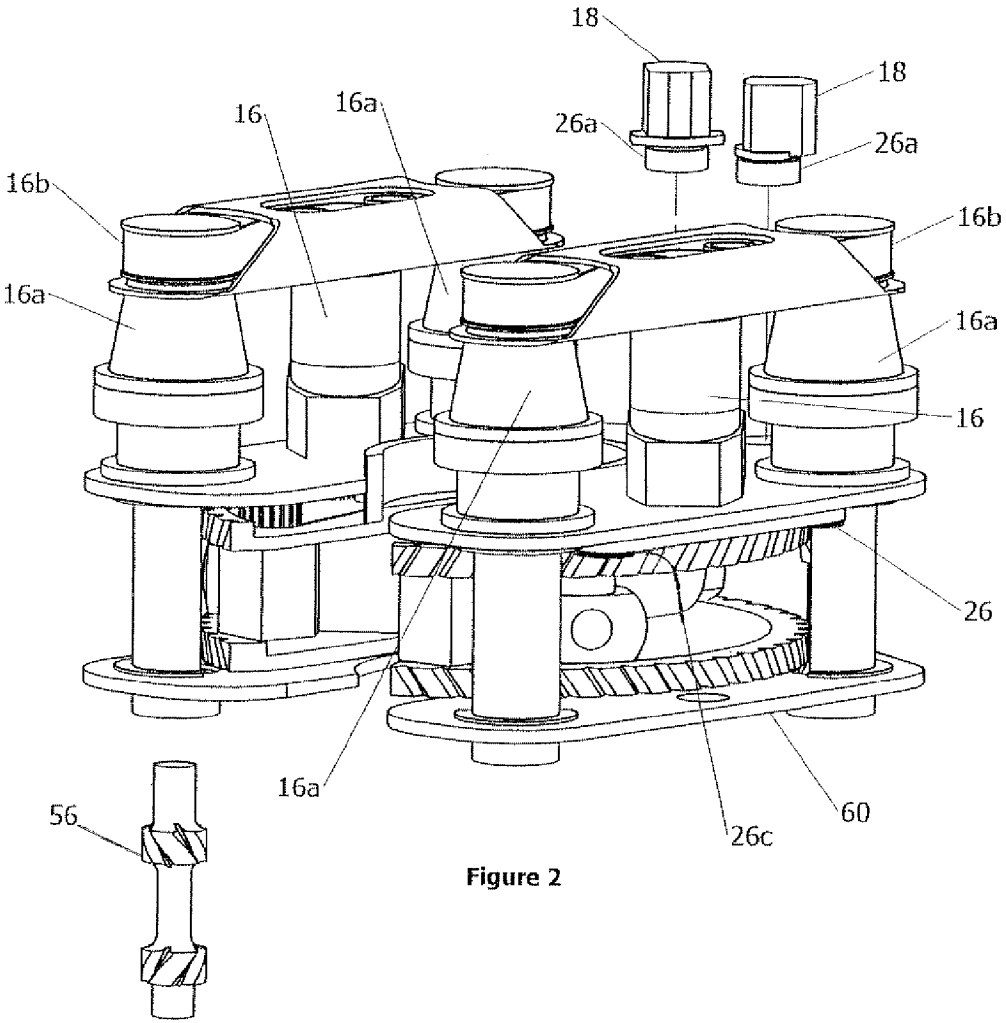
FIG. 2 is a perspective view of the main and rotary drive of the power tong of FIG. 1.

As seen in FIGS. 1 and 2, the power tong 6 may include three main sections mounted on a common axis A; namely a main drive section, a rotor, and a back-up jaw. Each of the sections contains actuators, as better described below. The main drive section 10 which provides at least part of a rigid stationary framework or stator frame is located above the rotor 22. The backup jaw 48, located below rotor 22, may also provide part of the stator frame. The rotor 22 rotates relative to the main drive and back-up jaw. Both the rotor and backup jaw clamp their respective sections of pipe. The rotor 22 is rotated by the main drive section 10 independently of the main drive section and backup jaw in the sense that the rotor 22 is self-contained, having on-board hydraulic and electric power generators to power on-board radial clamps or grippers (collectively herein referred to as grippers), and an on-board serpentine secondary power transmission, all configured to allow the insertion and removal of a pipe through a jaw opening from or into the center of the jaw, so that the pipe, when in the center of the jaw may be clamped, torqued, and spun about axis A of rotation of the rotor 22 while the other, oppositely disposed section of pipe is held clamped in the center of the back-up jaw 48.

Main drive section 10 includes primary drives 12, each of which includes rotary drive motors 16, which may for example be hydraulic or electric motors, gear reduction devices 16*a*, and belt drives 16*b* as better seen in FIG. 2. Motors 16 cooperate with drive pinions 56 to rotate rotor 22 about axis A relative to main drive section 10 and back-up jaw section 24.

Figure 3:
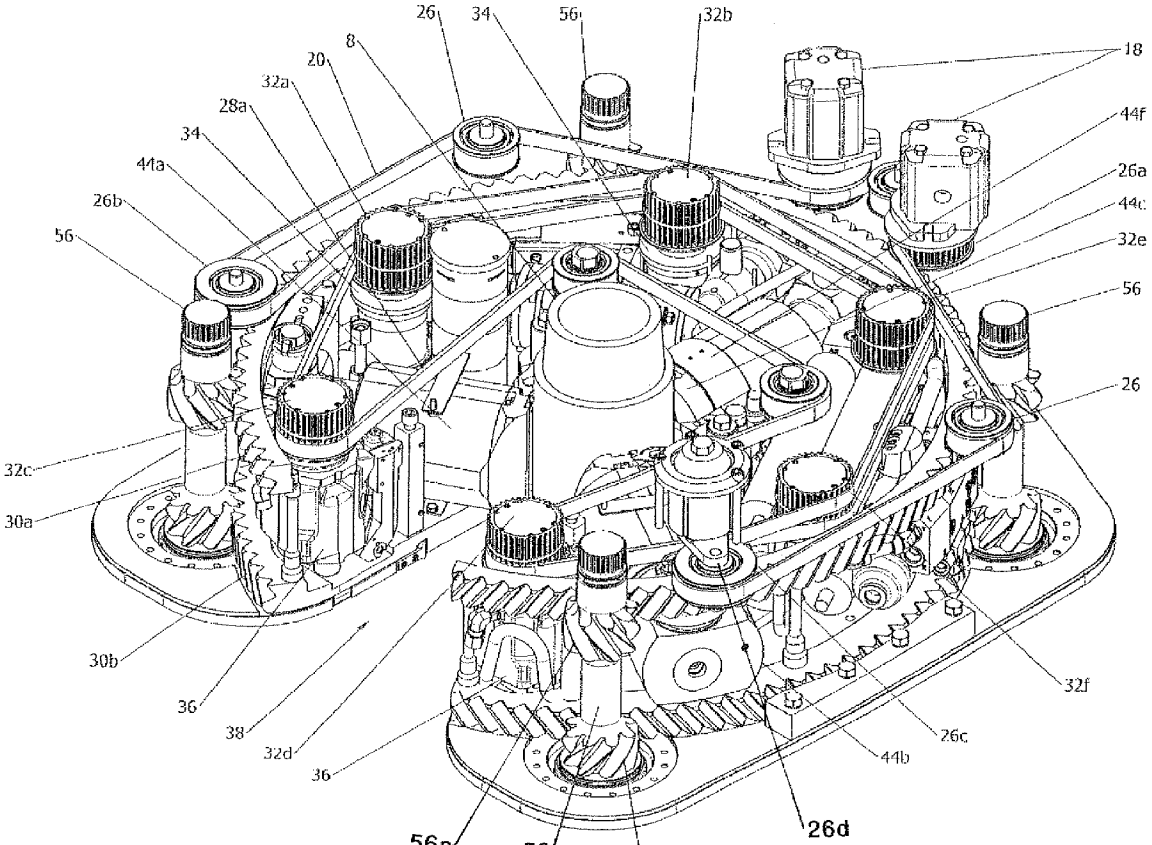
FIG. 3 is, in partially cut away perspective view, the rotary drive section and serpentine drive belt of the power tong of FIG. 1.

As shown in FIGS. 1, 2 and 3 rotor 22 is housed within drive section 10, although this is not intended to be limiting as the rotor may be mounted so as not to be housed within the drive section and still work. The rotor 22 is cylindrical in shape and has an opening slot, which although illustrated as linear may be linear or non-linear, having a throat 38 for passing of a tubular along the slot thereby allowing the tong axis of rotation A to be selectively positioned concentric with pipe 8, provided the rotor 22 is rotated such that its throat 38 is aligned with the front openings 28 and 29 of the main drive section and back-up jaw, respectively. Center 40 of the yoke formed by the jaw and slot corresponds with axis A. The rotary jaw 22 has three gripper cylinders 44*a*, 44*b*, and 44*c* arranged radially, with approximately equal angular spacing around axis A, mounted between the two parallel horizontal planes containing rotor gears 30*a* and 30*b*. The number of gripper actuators, such as gripper cylinders 44*a*-44*c*, and associated grips or grippers may be more or less in number, so long as a tubular joint may be gripped or clamped at center opening 40.

A serpentine member such as serpentine drive belt 20 is driven by two serpentine drive motors 18, which may for example be hydraulic or electric motors. The serpentine member is mounted around so as to engage stator sprockets mounted on the stator frame. For example the stator sprockets may include drive sprockets 26*a* which are driven by serpentine drive belt 20 to collectively provide a secondary drive powering the grippers on the rotor 22. Drive sprockets 26*a* rotate serpentine drive belt 20 about idler sprockets 26 mounted to drive section 10. And the serpentine drive belt 20 also engages about rotor sprockets 32*a*-32*f* mounted on the rotor 22 as better described below. The rotor sprockets 32*a* and 32*b* may be two generator drive sprockets. The rotor sprockets 32*c* and 32*d* may be two pump drive sprockets. Rotor sprockets 32*e* and 32*f* may be two idler sprockets. In the illustrated embodiment, which is not intended to be limiting as other embodiments discussed below would also work, the generator drive sprockets, that is, rotor sprockets 32*a* and 32*b*, transmit rotary power to generators 34. The pump drive sprockets, that is, rotor sprockets 32*c* and 32*d*, transmit rotary power to hydraulic pumps 36 by the action of serpentine drive belt 20 engaging the upper groove of rotor sprockets 32*a*, 32*b*, 32*c* and 32*d*. A synchronization belt, 28*a*, connects the lower portions of the rotor sprockets 32*a*-32*f*. Thus as the rotor 22 rotates on axis of rotation A, even though serpentine drive belt 20 cannot extend across the throat 38 because such a blockage would restrict selective positioning of the pipe 8 along the slot into the tong, serpentine drive belt 20 wraps in a C-shape around the rotor sprockets 32*a*-32*f*. Serpentine drive belt 20, driven by drive sprockets 26*a*, runs on pulleys 26, and on idler sprockets 26*b* and 26*c* mounted to, so as depend downwardly from, main drive section 10. The extent of the C-shape of serpentine drive belt 20 provides for continual contact between serpentine drive belt 20 and, in this embodiment which is not intended to be limiting, a minimum of three of the rotor sprockets 32*a*-32*f* as the rotor rotates relative to the main drive section 10. The synchronization belt 28*a* mounted on the rotor maintains rotation of the individual rotor sprockets as they pass through the serpentine gap 29 seen in FIG. 4, that is, the opening between sprockets 26*b* and 26*c*. Synchronization belt 28*a* synchronizes the speed and phase of the rotation of each of the rotor sprockets 32*a*-32*f* to allow each of them in turn to re-engage the serpentine drive belt 20 after they are rotated across the serpentine gap 29 by the action of the rotor rotating relative to the main drive.

As an example, when rotor 22 rotates in direction B, rotor sprocket 32*c* will reach the serpentine gap 29 and as that sprocket crosses gap 29 it is disengaged from serpentine drive belt 20, during which time rotor sprocket 32*c* and its corresponding pump continues to operate as it is driven by synchronization belt 28*a* rather than the serpentine belt 20. When rotation of rotor 22 continues such that rotor sprocket 32*c* passes further counter-clockwise, for example beyond idler sprocket 26*c* during unscrewing of pipe 8, then rotor sprocket 32*c* will re-engage with serpentine drive belt 20. The process repeats in succession as each of the six rotor sprockets 32*a*-32*f* passes across gap 29 between idler sprockets 26*b* and 26*c*.

Idler sprocket 26*c* is spring-mounted by means of resiliently biased tensioner arm 26*d* to maintain minimum tension in the serpentine drive belt 20 regardless of the rotational position of the rotor 22. This is advantageous as there is a small variation in the length of the path of the serpentine drive belt 20 as the rotor 22 rotates about axis A.

The serpentine drive belt 20 maybe a toothed synchronous drive belt in order to minimize belt tension requirements. The use of a drive belt having teeth (not shown) allows for small sprocket diameters and avoids dependence on friction which could be compromised by fluid contaminants. The serpentine belt may be double-toothed (that is, have teeth on both sides) or may be single-toothed with the teeth facing inward on the inside portion of the C-shaped loop and facing outward on the outer side portion of the C-shaped loop, where the serpentine drive motors 18 and corresponding drive sprockets 26*a* are positioned outside the C-shaped loop.

During operation of tong 6 the secondary drive (drive motors 18) and serpentine drive belt 20 run continuously to deliver power to the on-board pumps and generators by means of the rotor sprockets 32*a*-32*d*. Rotation of the rotor 22 by the operation of the primary drive acting on the pinions 56 and rotor gears 30*a* and 30*b* does not substantially affect the powering of the on-board accessories (pumps and generators) because drive belt 20 is run at substantially an order of magnitude greater speed than the speed of rotation of rotor 22. The rotation of the rotor only adds or subtracts a small amount of speed to the rotation of the rotor sprockets.

In an alternative embodiment serpentine drive belt 20 may be split into two or more separate 'C' sections. A plurality of separate synchronization belts may also be used instead of the single synchronization belt 28*a*. Alternatively, a roller chain could be used instead of the serpentine drive belt but likely would add lubrication requirements, would be noisier and would have a shorter life. The number of rotor sprockets may be increased or decreased and the number of pulleys 26, drive sprockets 26*a* and idler sprockets may also vary.

Upper rotor gear 30*a* and lower rotor gear 30*b* are parallel and vertically spaced apart so as to carry therebetween hydraulic pumps 36, generators 34, the rotor hydraulic system, rotor jaw electrical controls and the array of three radially disposed hydraulic gripper cylinders 44*a*, 44*b*, and 44*c*, all of which are mounted between the upper and lower rotor gears 30*a* and 30*b* for rotation as part of rotor 22 without the requirement of external power lines or hydraulic lines or the like. Thus all of these actuating accessories, which are not intended to be limiting, may be carried in the rotor 22 and powered via a nested transmission, nested in the sense that the C-shaped synchronization drive loop mounted on the rotor, exemplified by synchronization belt 28*a*, is nested within so as to cooperate with the C-shaped serpentine drive loop mounted to the main drive, exemplified by serpentine drive belt 20.

Thus as used herein, a serpentine belt, such as the serpentine belt 20, driving a plurality of stator and rotor sprockets (as herein below defined), and as in the various forms of the stator and rotor sprockets found illustrated in all the figures herein, are herein referred to generically as a form of nested transmission. The nested transmission transfers power from the fixed stage to the rotational stage in a continuous fashion as, sequentially, one element after another of the rotational drive elements on the rotating stage are rotated through and across throat 38 and gap 29 allowing selective access of the tubular 8 to the center opening 40 of the stage.

Other nested transmissions as would be known to one skilled in the art are intended to be included herein so long as the drive from the fixed stage to the rotating stage is substantially continuous as the rotating stage rotates sequentially one after another of the rotatable drive elements mounted on the rotating stage across the opening into the stage which provides selective access of the tubular 8 to center opening 40.

For proper operation of the tong, it is desirable that the gripper actuators such as gripper cylinders 44*a*-44*c* clamp the tubular 8 substantially at, that is, at or near the rotational center axis of the tong. It can be readily seen that gripping the tubular 8 with a significant offset from the center axis would result in wobble or runout of the tubular when spinning in or out and could result in thread damage, excessive vibration, damage to the machine and inaccurate torque application.

Figure 7:
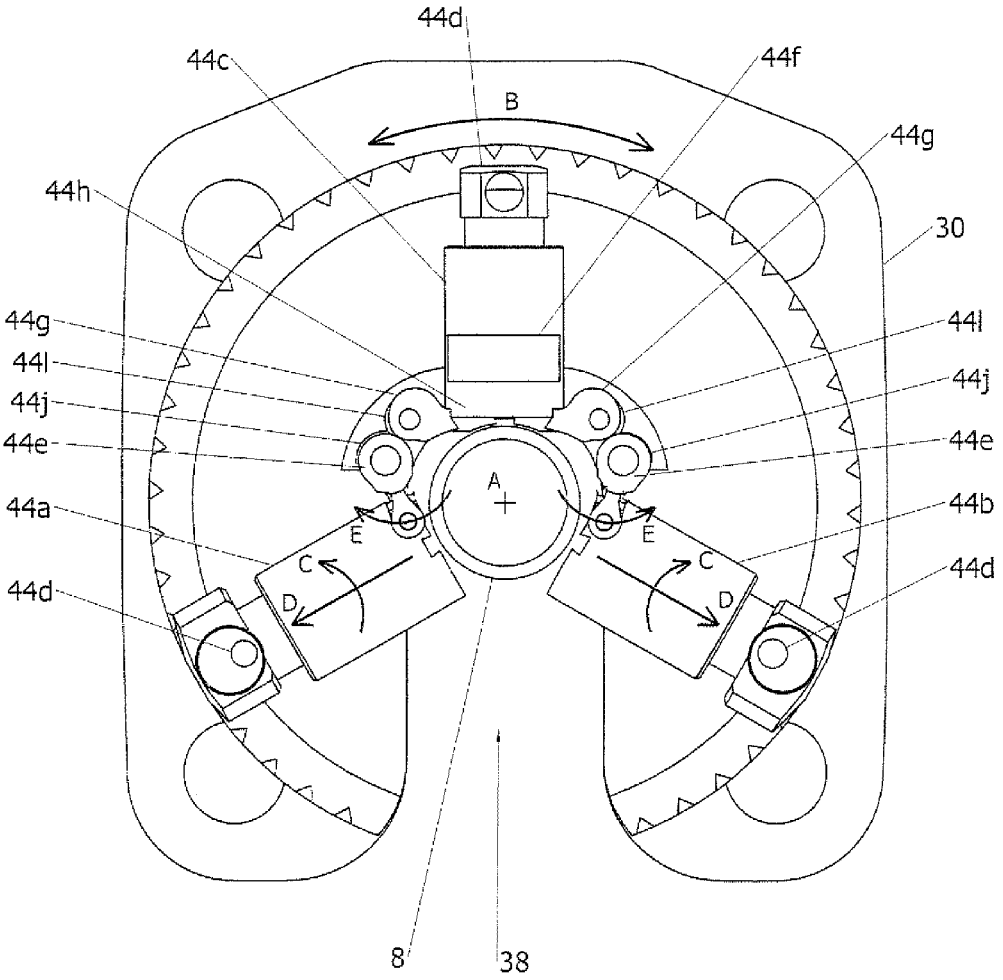
FIG. 7 is a partially cut away view along line 7-7 in FIG. 5.
Figure 8:
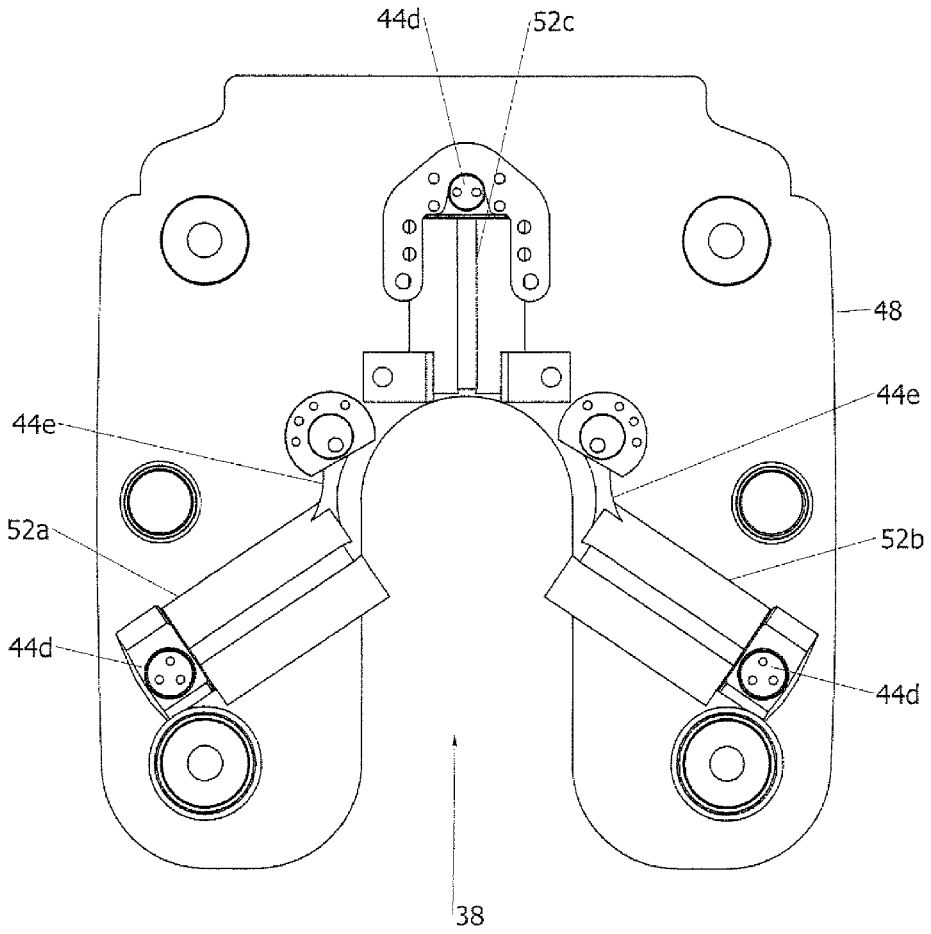
FIG. 8 is a partially cut away view along line 8-8 in FIG. 5.
Figure 9:
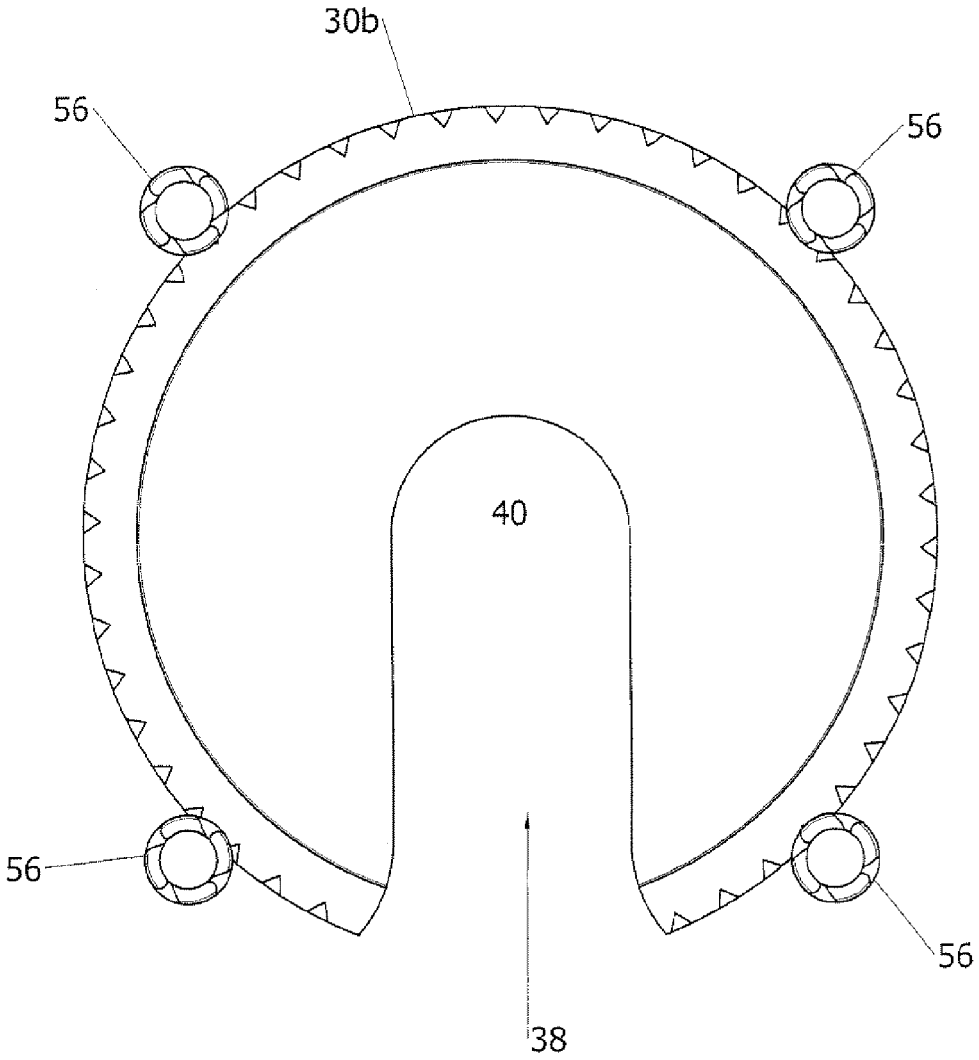
FIG. 9 is a partially cut away view along line 9-9 in FIG. 5.

As described above, the rotor preferably has three gripper cylinders 44*a*, 44*b* and 44*c* arranged radially around the tubular 8 and spaced nominally 120 degrees apart as shown in FIG. 7, leaving the throat 38 and slot leading into the center opening 40 of the yoke, centered in axis A, clear when the gripper cylinders are retracted.

The gripper cylinders are pinned at their outboard end to the rotor gears by means of pins 44*d*. Pins 44*d* react the grip cylinder radial clamping force to the rotor gear structure 30. Pins 44*d* may include an eccentric range adjustment system.

The gripper cylinders are preferably mounted rod-out, body-in for best structural advantage but the mounting could be inverted.

Near the inboard end of each gripper cylinder, the lateral force due to the applied torque must be reacted to the rotary gear structure 30, without allowing excessive side loading of the internal working parts of the cylinders. For the side gripper cylinders 44*a* and 44*b* adjacent to the throat 38, this lateral force is reacted by reaction links 44*e* which pivotally connect the inboard end of the gripper cylinders to the rotor gear structure 30. For the rear gripper cylinder 44*c*, the lateral force is reacted by cylindrical guide 44*f*.

It will be appreciated that the inboard ends of side gripper cylinders 44*a* and 44*b* move in an arc as the gripper cylinders are extended or retracted. For the side gripper cylinders 44*a* and 44*b*, the geometry of reaction links 44*e* is optimized to minimize deviation from the nominal gripper cylinder radial axis over the gripping diameter range to angles typically less than one degree. The gripper cylinders 44*a* and 44*b* will however swing significantly from the nominal gripper cylinder radial axis, in the order of five degrees, when they fully retract to clear the throat 38. It is an advantage of the link design that it requires less stroke to clear the throat 38 due to the swing associated with the arc of reaction links 44*e*, which ultimately allows a more compact rotor and hence a more compact tong. That is, the combination of the swing in direction C with the retracting stroke in direction D results in less of a stroke length required to clear throat 38 than merely using a retraction stroke without swing. The amount of swing is governed by the radius of arc E associated with rotation of the reaction links 44*e* and the length of the required stroke in direction D.

Synchronization links 44*g* are pivotally mounted to the rotor structure 30 and engaged in lateral grooves 44*h* on either side of the rear gripper cylinder 44*c*. Synchronization links 44*g* do not react the lateral force due to torque but rather control the extension magnitude of the rear gripper cylinder 44*c* in coordination with the side gripper cylinders 44*a* and 44*b*, resulting in centralization of the gripped tubular 8 at the rotational axis A of the rotor.

Reaction links 44*e* and synchronization links 44*g* have timing gears 44*j* and 44*i* respectively attached or integral at the ends that pivot on the rotor gear structure 30. Reaction link timing gears 44*j* engage with synchronization link timing gears 44*i*, constraining the displacement angles of the synchronization links 44*g* equal and opposite to the displacement angles of reaction links 44*e*. The geometry is optimized to ensure that the tubular 8 is gripped close to the rotational axis A of the rotor, for example within about one mm, over the entire gripping diameter range.

The back-up jaw section 24 as shown in FIGS. 5, 5*a*, 6 and 8 is typically mounted to a tong positioning system capable of holding the tong assembly level and enabling vertical and horizontal positioning travel. The tong may be pedestal-mounted on the rig floor, mast-mounted, track-mounted on the rig floor or free hanging from the mast structure. It may also be mounted at an angle for slant drilling application or with the pipe axis horizontal.

The back-up jaw section 24 includes a parallel spaced apart array of planar jaw frames and in particular an upper backup jaw plate 48*a* and a lower backup jaw plate 48*b*. Backup jaw plates 48*a* and 48*b* may be maintained in their parallel spaced apart aspect by structural members 48*c*. Thread compensator cylinders 50 actuate so as to extend bolts 46 on rods 50*a* in direction F so as to selectively adjust the vertical spacing between the rotor section 23 and the backup jaw section 24. Thus with the cylindrical threaded joint 8*a* of tubular 8 held within cylinders 52*a*-52*c* in the backup jaw section 24 (that is with joint 8*a* held lower than shown in FIG. 3 so as to be clamped between the cylinders 52*a*-52*c* of the back-up jaw section 24), and as seen in FIG. 1 with threaded tapered female end or box opening upwardly in the joint 8*a* held within cylinders 52*a*-52*c*, as the rotor 22 is rotated relative to the fixed back-up jaw section 24 so as to rotate the box relative to the opposed facing pin, the rotor 22 and back-up jaw 48 may be drawn towards one another by the retraction of rods 50*a* into thread compensator cylinders 50 in direction F or alternately, separated from on another by the extension of rods 50*a* from cylinders 50. This action serves to compensate for the axial thread advance of the tubular as it is screwed in or out and avoids excessive axial forces on the tubular threads. The combined upward force exerted by thread compensator is controlled via the hydraulic pressure to approximately equal the weight of the upper tubular. Thus a further advantage of the invention is a reduction of tubular thread wear because the threads are "unweighted" when spinning in or out. The spacing between the back-up jaw plates 48*a* and 48*b* defines a cavity in which is mounted the array of hydraulic gripper cylinders 52*a*, 52*b* and 52*c* positioned radially about axis A and in approximately equal angular spacing. Hydraulic cylinders 52*a*-52*c* are disposed radially inward in an arrangement corresponding to that of cylinders 44*a*-44*c* so that the operative ends of the cylinders 52*a*-52*c* which may be selectively actuated telescopically into the center opening 40 of the yoke so as to clamp therein a tubular 8 and in particular a lower portion of a tubular joint while an upper portion of the tubular joint is clamped within cylinders 44*a*-44*c* and rotated in rotary jaw section 23 in direction B about axis of rotation A relative to the fixed main drive section 10 and back-up jaw section 24.

As shown in FIG. 1, the rotor 22 is maintained in alignment with axis of rotation A by means of upper and lower guide bearings 54*a* and 54*b* respectively. The top of the rotor 22 has a cylindrical race 54*c* bolted to the top surface. Race 54*c* slides within upper guide bearing 54*a* fixed to the top plate of frame 60. Similarly, the bottom surface of lower rotor gear 30*b* is profiled to create a race which slides within lower guide bearing 54*b* fixed to the lower plate of frame 60. The upper and lower bearing rings are interrupted, that is do not complete a full circle, so as to match the opening of throat 38 of the frame. Another guide method may include guide rollers which are rotatably mounted in a array circumferentially around the outer circumference of the rotor with their rotational axis parallel to rotation axis A. In the present embodiment, upper and lower guide bearings 54*a* and 54*b* centralize the rotor 22 along rotational axis A and ensure proper meshing of the rotor gears 30*a* and 30*b* with the drive pinions 56.

The drive pinions 56, a minimum two but ideally four, are arranged circumferentially around the rotor 22 and intermesh and engage helical teeth with corresponding rotor gear teeth on the outer circumference of rotor gears 30*a* and 30*b* so that as drive pinions 56 are driven by main drive hydraulic motors 16 via gear reduction devices 16*a* rotor gears 30*a* and 30*b* are simultaneously rotatably driven (in either direction) about axis of rotation A. Pinions 56 and the corresponding rotor gear teeth are helical. Each drive pinion 56 has its rotational axis parallel to axis A and consists of an upper pinion 56*a* and a lower pinion 56*b*. The helix angles of the upper rotor gear 30*a* and lower rotor gear 30*b* are equal and opposite to ensure proper meshing torque splitting between top and bottom rotor gears. The rotor 22 is mounted within a-frame 60, wherein frame 60 may be a frame or housing. The primary drives 12 and driver 18 are mounted on top of frame 60, and back-up jaw section 24 is mounted beneath frame 60.

Figure 10:
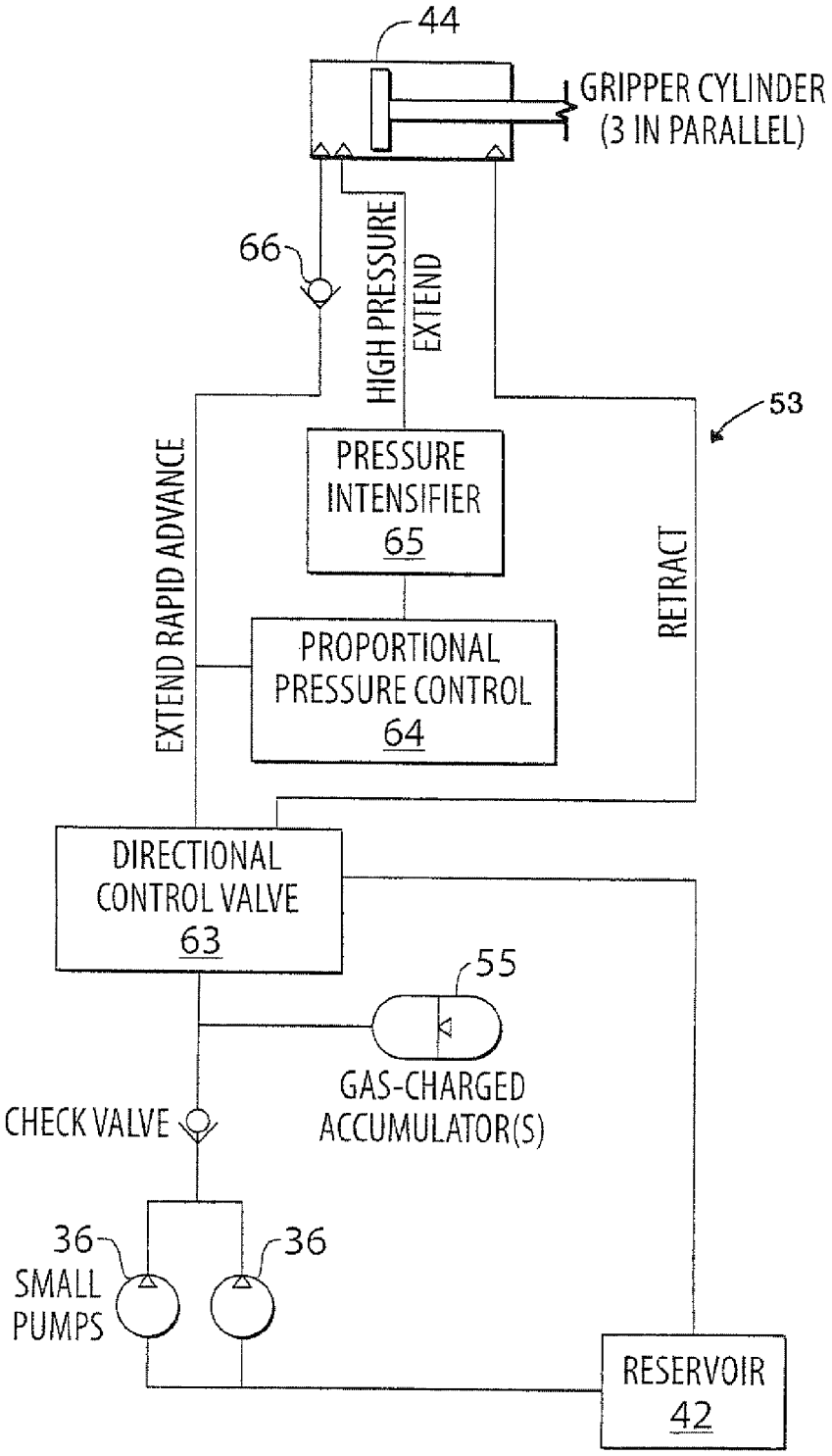
FIG. 10 is a hydraulic schematic of a rotor.

In the preferred embodiment, as seen in FIG. 10, the rotor hydraulic system 53 is a dual (high/low) pressure system or infinitely variable pressure system which produces high pressures (in the order of 10,000 psi) necessary for adequately gripping large and heavy-duty tubulars and for applying make-up or break-out torque, and lower pressures (2500 psi or less) to avoid crushing smaller or lighter-duty tubulars. Hydraulic pumps 36, rotationally driven as described above, are fixed-displacement, gear or variable displacement piston pumps. In the idle state, hydraulic pumps 36 charge one or more gas-filled accumulators 55 mounted in or on rotor 22 to store energy to enable rapid extension of the gripper cylinders 44*a*-44*c*. In this way, very fast gripping speeds may be achieved while keeping the power transmitted by the serpentine drive belt 20 drive low. That is, although the power supplied via the serpentine drive belt is small, the rotor hydraulic system must be able to intermittently supply a relatively large flowrate at low pressure for rapid advance of the gripper cylinders until they contact the tubular and also supply a low flowrate at very high pressure, in the order of 10,000 psi, to adequately grip the tubular for torquing operations.

In the schematic of the preferred rotor hydraulic system 53 of FIG. 10, system 53 has one or two gear or piston pumps 36 of relatively small capacity, within the power limitations of the serpentine drive belt. When there is no gripping demand, the pumps charge one or more gas-filled accumulators 55 to store energy for intermittent peak demands. The accumulators are optional, for the benefit of advance speed. The system is workable without accumulators provided the pumps are variable displacement. A load-sensing circuit with or without regenerative advance may also be used as would be understood by someone skilled in the art. A directional control valve 63 directs hydraulic pressure to the gripper cylinders. The directional control valve is solenoid-actuated with the solenoids controlled by the rotor control system. There are two flow paths from the directional control valve 63 to the extend side of the gripper cylinders. The first is the rapid-advance flow path which directs a large flowrate, in the order of thirty-five gallons per minute, from the pump(s) 36 and accumulator(s) 55 to the gripper cylinders at relatively low pressure, in the order of 2500 psi, for rapid extension of the gripper cylinders until they contact the tubular 8. The second is the high-pressure path in which pressure is regulated by a proportional pressure control valve 64 which is controlled by the rotary jaw control system of FIG. 11. The regulated pressure is supplied to an intensifier 65 which boosts the pressure by a factor in the order of 4:1 to supply high pressure, in the order of 10,000 psi, to the gripper cylinders. A check valve 66 prevents the high pressure fluid from flowing back into the rapid-advance low pressure flow path. The directional control valve 63 can also be solenoid actuated to direct fluid to the rod side of the gripper cylinders for retraction.

The use of high grip pressures, in the order of 10,000 psi, allows the use of compact gripper cylinders which results in a compact tong. By using the intensifier 65 to build the high grip pressure, no high pressure control valves are required.

When torquing, the control system monitors the applied torque and controls the grip pressure via proportional pressure control valve 64 at an appropriate level to avoid slippage of the tubular 8 clamped in the three gripper cylinders. The grip pressure is adaptive according to applied torque which avoids both slippage caused by inadequate pressure and crushing of the tubular 8 caused by excessive pressure.

It can be seen that in spite of the small input power, the hydraulic system can intermittently supply large flowrates for rapid grip cylinder advance and high pressures for high-torque operations. The system can regulate the grip pressure, adapting to the applied torque, for optimum gripping performance.

Figure 11:
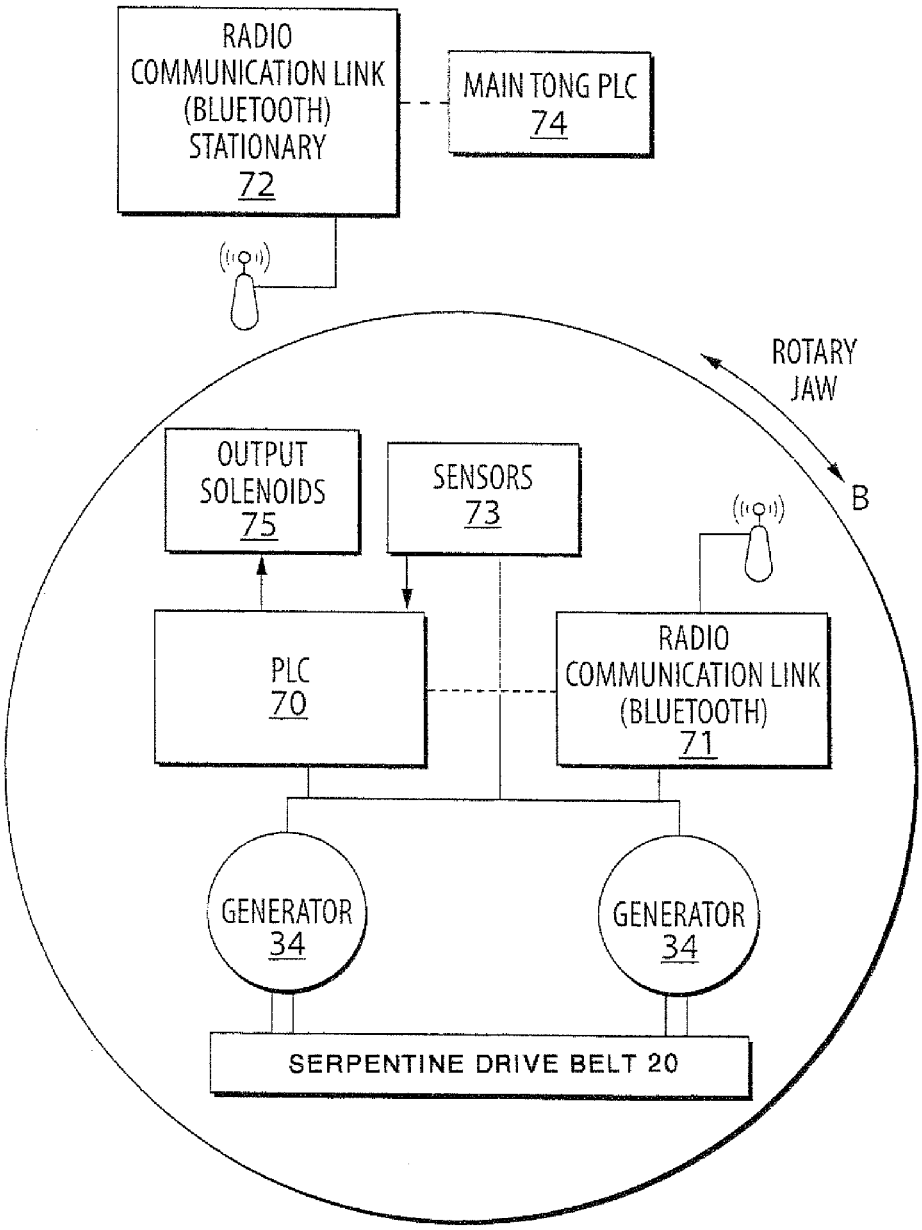
FIG. 11 is a control system circuit of a rotor.

The rotor control system seen in FIG. 11 activates and de-activates the gripper cylinders at the operator's discretion, regulates grip pressure and monitors system function without any power supply or control wires from or to the fixed part of the tong, because the rotor is fully rotatable and the open throat of the yoke precludes the use of any slip rings which are commonly used to transmit electrical power and control signals to a rotating element.

As seen in FIG. 11, one or two generators 34 are driven by the serpentine belt drive 20. They supply power, preferably 24 volts DC, to a programmable logic controller (PLC) 70, a radio communication link 71 and a number of sensors 73.

The radio communication link 71, which may advantageously be a Bluetooth™ device, communicates wirelessly with a similar radio communication link 72 mounted on the stationary section of the tong. The two radio communication links, 71 and 72, act as a wireless communication bridge between the main tong control system 74 and the rotor PLC 70.

The rotor PLC 70, as directed by the main tong control PLC 74, controls the output solenoids on directional control valve 63 to extend and retract the gripper cylinders 44*a*-44*c* and the proportional pressure control valve 64 to control the grip pressure. It also receives feedback from sensors 73 on the rotor for such parameters as (possibly including but not limited to) grip pressure, hydraulic pump pressures, grip position and hydraulic oil temperature.

It can be seen that the rotor control system is fully self-contained allowing unlimited rotor rotation, with no wired connection to the main control system but with full control and monitoring communication.

For proper make-up of drilling tubulars, it is necessary to measure the applied make-up torque and cease torquing at a prescribed torque value or within a range of allowable torque values.

Figure 13:
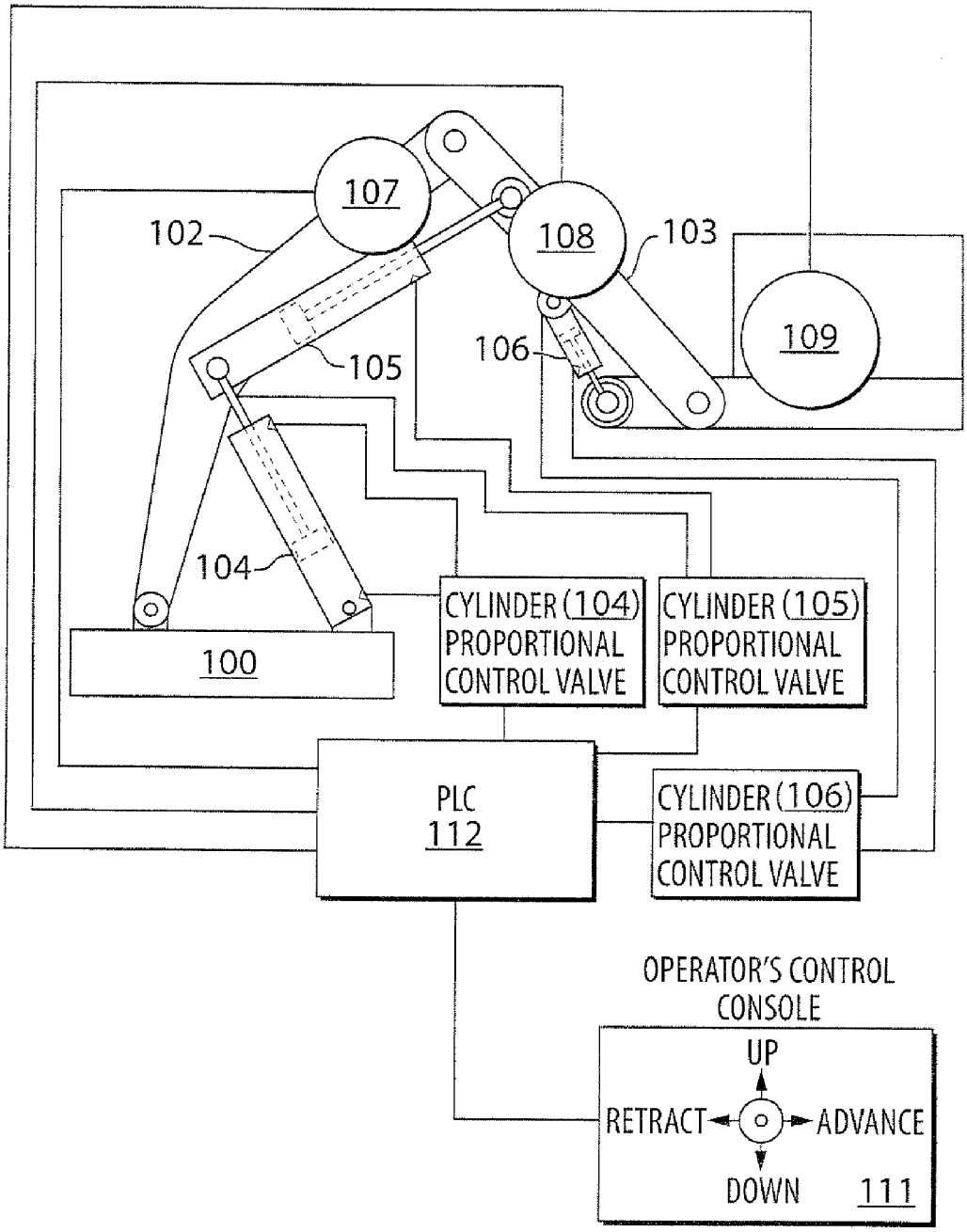
FIGS. 13 and 14 are diagrammatic flow charts of the controls of the manipulator of FIG. 12*a*.

For typical drill pipe or drill collar connections, which have relatively high make-up torque specifications and a relatively wide torque tolerance range, the torque can be adequately computed by a programmable logic controller (PLC) 112, seen in FIG. 13, proportional to the differential pressure applied to the main drive motors 16 and measured by pressure sensors.

For make-up of casing or some specialized drillpipes, the make-up torque specification can be much lower and the torque tolerance range smaller such that a more accurate means of torque measurement is desired, without inaccuracies due to drive friction and hydraulic motor efficiency.

Figure 6:
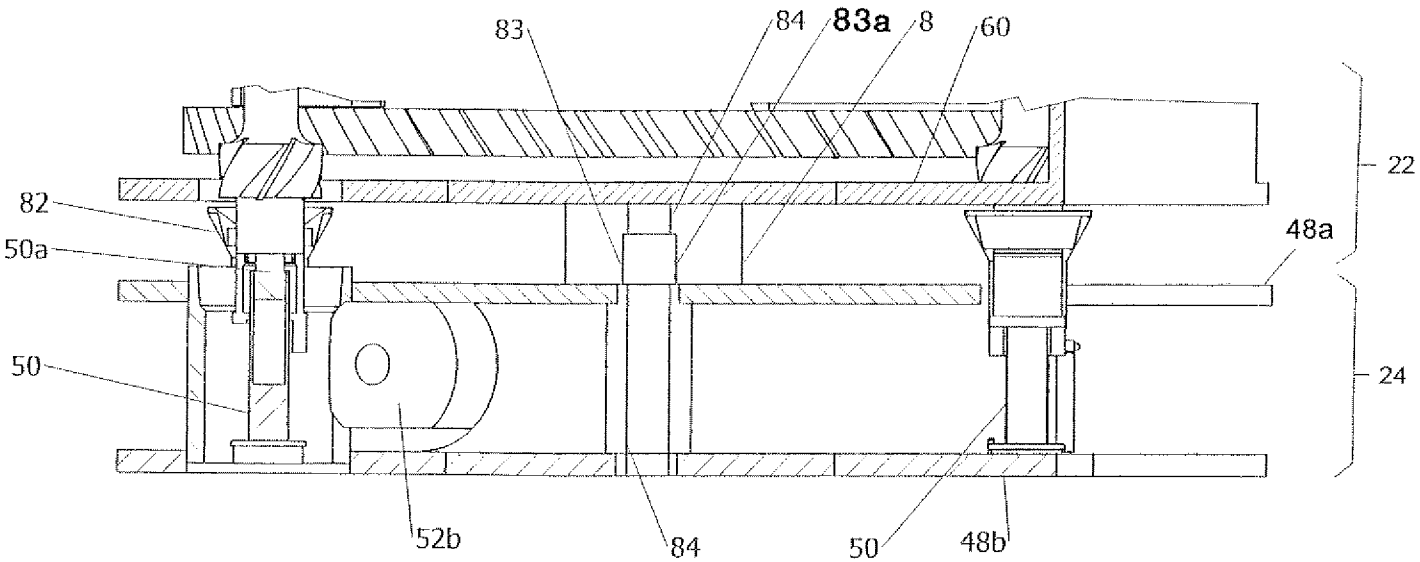
FIG. 6 is a section view along line 6-6 in FIG. 5*b*.

In the present invention, the rotor 22, frame 60, and primary drives 12 are rotationally independent of the backup jaw section 24. As shown in FIG. 6 the rotor 22 is axially supported by the thread compensator cylinders 50 which are mounted with spherical bushings 82 at both ends so that they do not react any torque between the frame 60 and the back-up jaw section 24.

Frame torque is reacted to the backup jaw section 24 via two reaction beams 83 mounted in the backup jaw section 24 and with their top ends connected to the frame 60 via spherical bearings 84. The reaction beams 83 are free to slide vertically relative to the backup jaw section 24 in guide bushings 84 to allow for thread advance compensation travel. Guide bushings 84 restrain the reaction beams 83 laterally so that they are effectively cantilevered upward from the backup jaw section 24. The torque of the rotary jaw frame 60 is reacted at the top of the reaction beams 83.

For accurate torque instrumentation, the reaction beams 83 are optionally fitted with electronic strain gauges to form shear-beam load cells 83*a*. The signals from the load cells 83*a* are input to the PLC 112 for torque instrumentation.

When breaking out (unscrewing) drilling tubulars, it is often difficult to identify the axial location of the split where the two tool joints meet. It is imperative that the tong be positioned such that the split is located in the axial gap between the rotor grippers and the back-up jaw grippers. If either the rotor or the backup jaw grips across the split, the tool joint and the tong may be damaged and time will be wasted because the connection will not break out.

Figure 15:
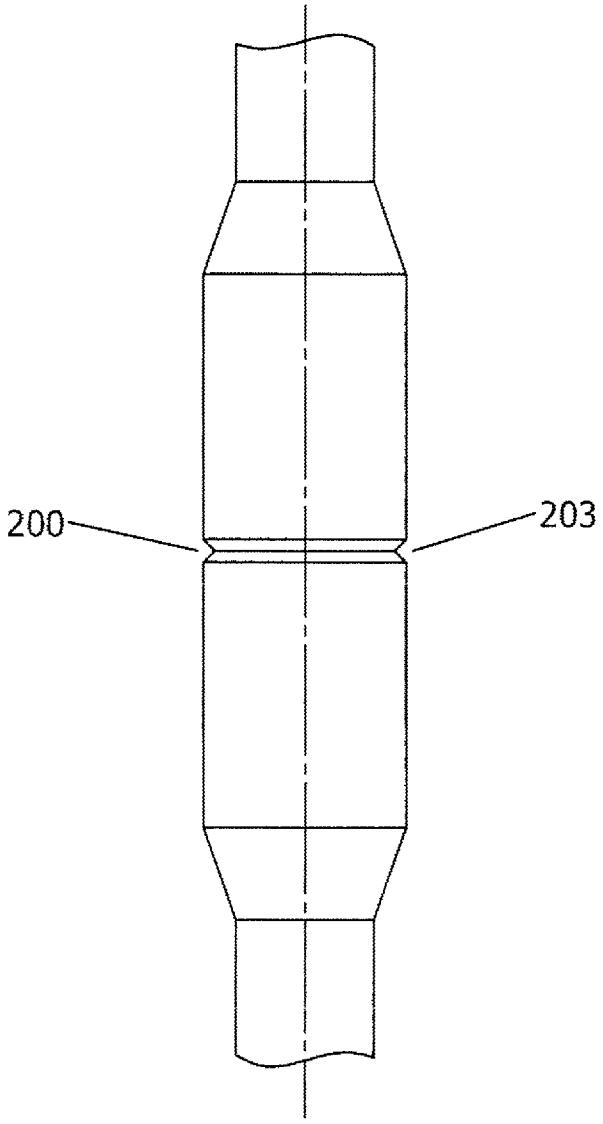
FIG. 15 is, in side elevation view, mated tool joints showing the split seam between the joints.
Figure 16:
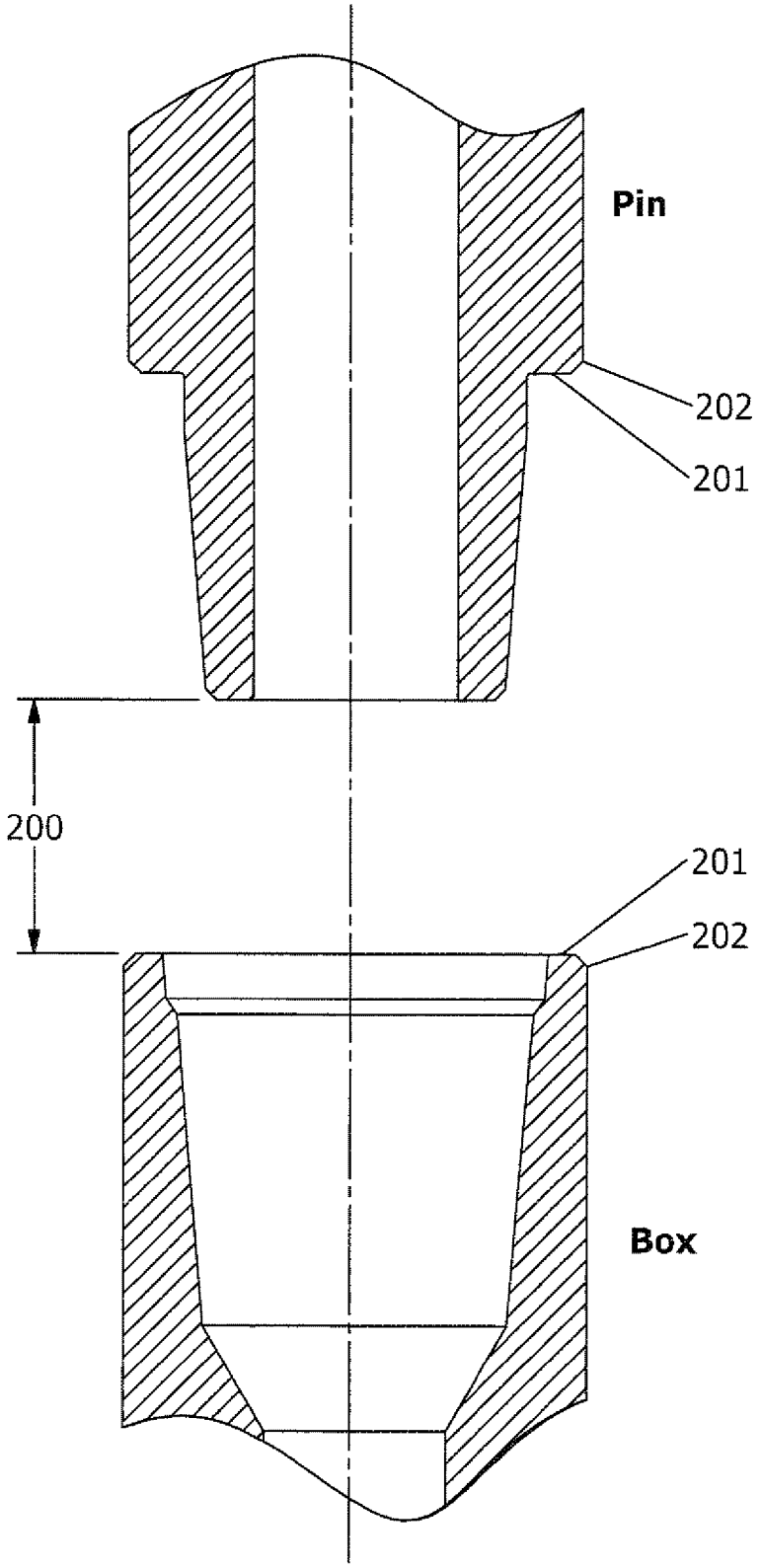
FIG. 16 is, in cross sectional view along the axis of rotation of the tubular, the mated tool joints of FIG. 15, with the tool joints un-threaded from one another.

As shown in FIGS. 15 and 16, the actual face seam 200 between the mating connection shoulder faces 201 is only marginally visible when the connection is made up and it may be further obscured by drilling fluid. There is typically a shoulder bevel 202 adjacent to each shoulder face 201. The shoulder bevel 202 is typically machined at a 45 degree angle and has a radial dimension typically 2 to 6 mm. The two adjoining shoulder bevels 202 combine to form a connection split bevel V-groove 203. The connection split bevel V-groove 203 is usually sufficiently visible to identify the split axial location for placement of manual tongs in conventional drilling operations. But for a mechanized tong with its operator positioned several feet away from the pipe, it may be difficult to see. Furthermore, the tong may obscure the operator's direct view of the split location. Time will be wasted in identifying the split location, traveling to it and verifying that the split is correctly located in the axial gap between the rotary and back-up jaws.

For automated pipe-handling operations, it is important for the machine to identify and travel to the correct axial location of the split without control intervention by the operator.

It can be seen that a reliable automated system to detect the location of the connection split would improve speed and efficiency of a mechanized tong and is mandatory for fully-automated tong operations.

Figure 17:
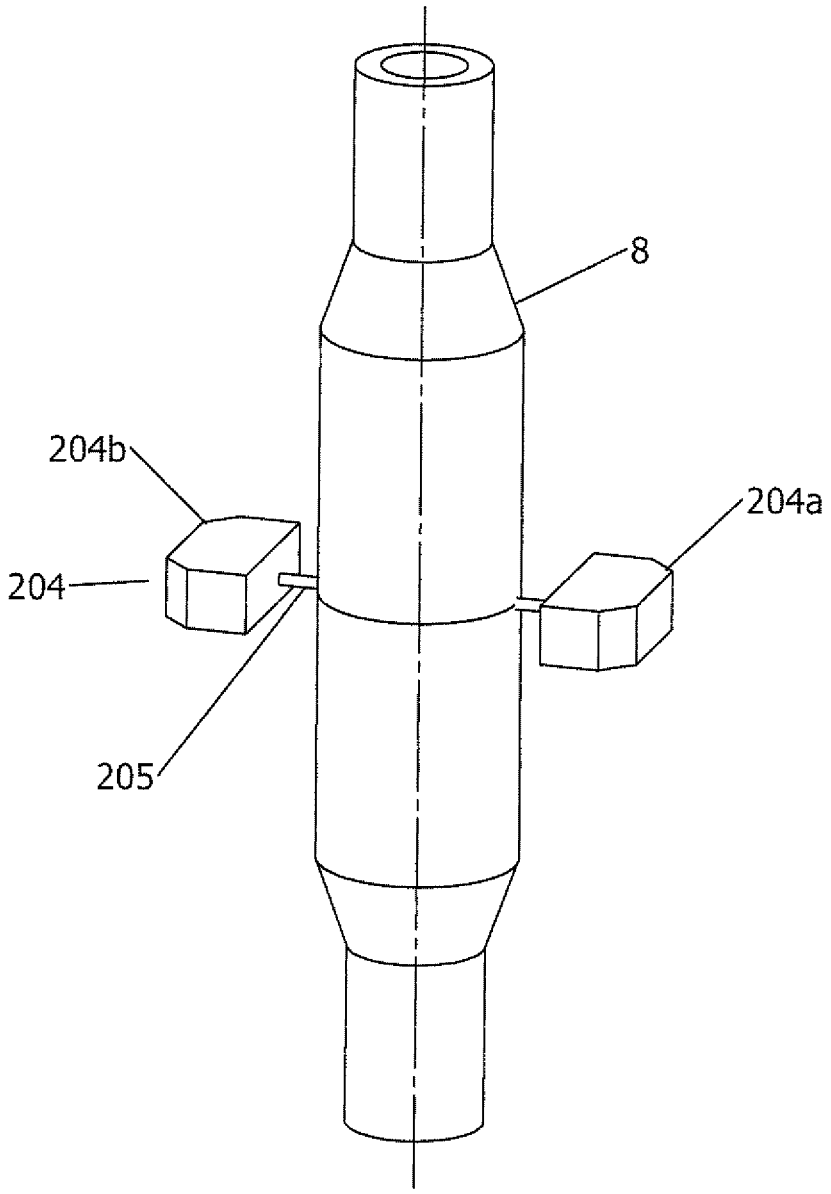
FIG. 17 is, in perspective view, the mated tool joints to FIG. 15 showing a non-contact sensor detecting the split seam between the tool joints.

As shown in FIG. 17, an optical caliper system 204 may be used to measure the outside diameter of the tool joint 8.

A tandem configuration may be employed. That is, the optical tubular caliper can be accomplished with a pair of single point beam sensors positioned approximately 180 degrees apart, with each beam projected radially inward toward the tubular at the same elevation. Each sensor measures the radial distance to the pipe surface. The control system computes the sum of these distances. The difference between a fixed offset value and the computed sum represents the diameter of the tubular, approximately independent of the position of the tubular in the opening. The system can quickly and accurately measure the diameter of any tubular passing through the single point beams and transmit the diameter measurement to the tong control system. Furthermore, as the tong travels axially along the pipe, the tong control system can relate a series of such diameter measurements to the corresponding tong elevations as measured via the control system instrumentation described elsewhere. A diameter profile along the length can thus be created, effectively a virtual diameter versus axial position plot. The control system can compare this diameter profile to the known characteristic of the connection split bevel V-groove 203. When such a profile match is identified, the connection split is located and the corresponding tong elevation is recorded. The tong then travels the contact axial offset distance between the light band 705 axial mounting position and the desired split position between the rotary and back-up jaw grippers.

As would be known to one skilled in the art, an optical caliper system that uses a light source projecting a sheet or thin band of light instead of single point light sources may also be employed. A receiving unit senses or monitors the dimensional characteristics associated with any portion of the light which is blocked by the target object such as tool joint 8 located between the light source or sources and the receiving or sensing units. Thus, as with the use of single point light sources, the sheet or band light sources may also accurately measure the diameter of a cylindrical target object such as a tool joint 8 without any physical contact.

The control system is programmed to tune out irrelevant variations in the measured outside diameter, such as at the tool joint upset steps. It will also filter out diametral noise associated with surface irregularities such as hardbanding, tong marks or wear grooves.

It can be seen that the system can quickly and accurately locate the axial position of the connection split on the tool joint and works obtrusively and reliably, with no direct contact with the pipe. The detection system has no moving parts.

The automated split detection system will improve the operational speed and efficiency of the tong and will enable automated tong operations.

As mentioned above, the power tong according to the present invention may be mounted in many ways on the drilling rig structure, or it may also be free-hanging from a cable. The mounting method ideally allows the tong to be accurately positioned around the tubular 8 at a large range of elevations, retracts a substantial distance from well center for clearance for other well operations, parks in a small area to minimize space usage on the drilling rig floor, keeps the tong level and allows the tong to be positioned to work at multiple locations such as the mousehole which may not be in the same plane as well center and the tong park location. The mounting system could be capable of rapid movement between working and idle positions but with smooth, stable motions. It should allow the operator to command horizontal or vertical movements or a combination.

Numerous tong or wrench mounting mechanisms exist in the industry. Most are Cartesian (horizontal/vertical) manipulators employing tracks, slides or parallelogram linkages for each motion axis. These mechanisms are simple to control because they directly actuate on the horizontal and vertical axes but they typically have a small range of motion which limits tong functionality and restricts mounting location on the drill floor. They have a large parked footprint which consumes scarce rig floor space and interferes with other well operations. And they have little or no capability to react torque applied to the tong or wrench by a top drive in the rig.

Figure 12A:
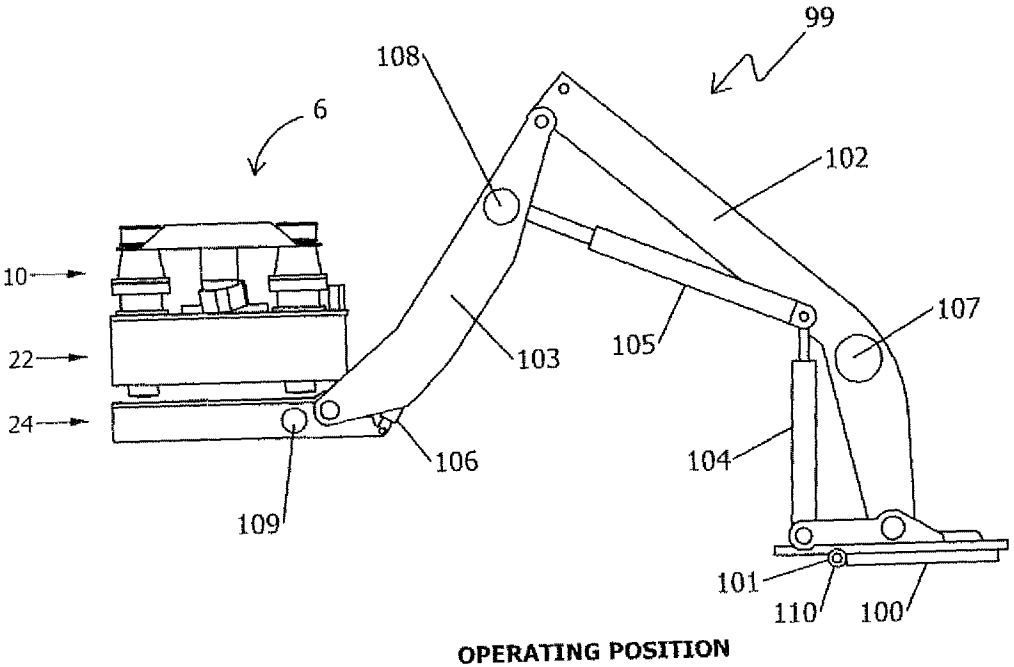
FIG. 12*a* shows a power tong according to the present invention on a manipulator in an extended position.
Figure 12B:
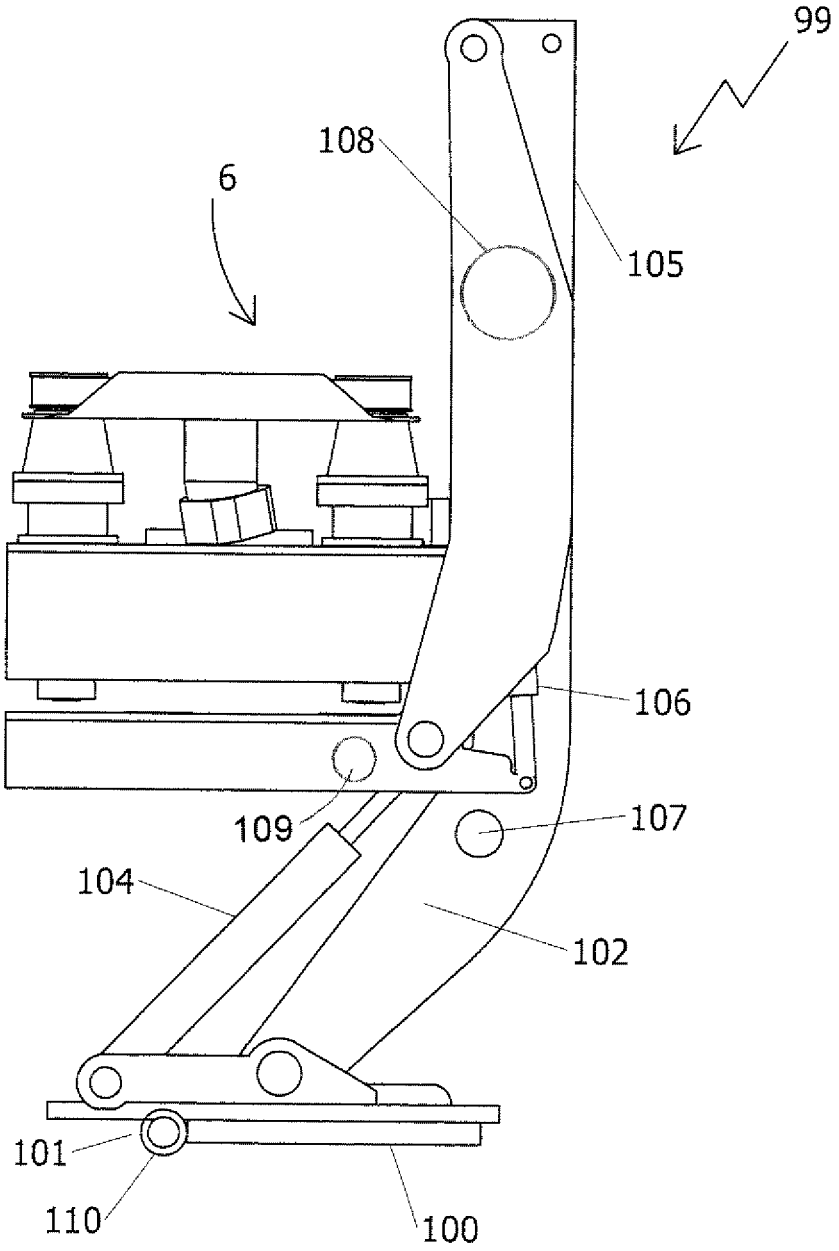
FIG. 12*b* shows the manipulator of FIG. 12*a* in a parked position.

Thus in one preferred embodiment, a tong is preferably mounted on a manipulator 99 as shown in FIGS. 12*a* and 12*b*. A slewing base 100 is mounted to the drilling rig floor. A hydraulic slewing motor 101, via a gear reduction, can turn the slewing base up to three hundred and sixty degrees about the vertical axis. The internal bearings of the slewing base can support the weight and overturning moments of the manipulator structure and the tong. Slewing motor 101 may alternatively be electric, pneumatic or manually actuated.

A first boom, boom 102, is pivotally mounted to the slewing base 100. Boom 102 is rotated in a vertical plane about its base pivot by linear actuator(s) 104. Its inclination is monitored by angle sensor 107.

A second boom, boom 103, is pivotally mounted at the top of boom 102. The angle of boom 103 relative to boom 102 is controlled by linear actuator(s) 105. The inclination on boom 103 is monitored by angle sensor 108.

The tong is pivotally mounted at the end of boom 103. The angle of the tong relative to boom 103 is controlled by linear actuator(s) 106. The inclination of the tong is monitored by angle sensor 109.

The actuators 104, 105 and 106 can be single or paired and are preferably hydraulic cylinders but could be screw actuators drive by electric or hydraulic motors or any other form of linear actuators. Alternatively, rotary actuators at the pivot axes could be used.

Angle sensors 107, 108 and 109 are preferably inclination sensors rigidly mounted to the structure which measure the angular displacement from a gravitational reference. Shaft-driven angle transducers could also be used. Position feedback could also be achieved using linear displacement transducers in or adjacent to actuators 104, 105 and 106.

Various possible tong positions are selectively positioned between the extended operating position illustrated in FIG. 12*a* and the parked position of FIG. 12*b*. It can be seen that the manipulator 99 provides a large range of motion but can park the tong 6 with a small footprint.

The booms have significant lateral and torsional stiffness. This is advantageous over prior systems because the structure can react torque applied to the tong by a top drive in the rig, such as for back-up of drilling connection make-up. The tong can also apply torque to make up a bit restrained in the rig's rotary table.

Manipulator 99 may be fully functional with manual controls for each of the four output actuators (slewing motor 101 and linear actuators 104, 105 and 106). However, it preferably has a control system as described below in which horizontal and vertical rates of tong travel are controlled in direct proportion to horizontal and vertical velocity commands by the operator and the tong is automatically kept level. The control system may also include the capability of optimized travel, including acceleration and deceleration control, to pre-defined locations.

The tong's vertical and radial positions (relative to the slewing base) at any time are computed by the programmable logic control (PLC) 112 geometric constants and the boom 102 and 103 angles measured by angle sensors 107 and 108. The slewing orientation is measured preferably by an encoder 110 on the slewing drive. The tong's three-dimensional position is therefore monitored at all times.

The preferred operators control console has a single 3-axis joystick 111 for control of the manipulator. The x-axis of joystick 111 controls the horizontal motions of the tong, the y-axis of the joystick 111 controls the vertical motions of the tong and the z-axis (handle twist) of the joystick controls the slewing motions of the assembly. The joystick commands may be discrete ON/OFF but are preferably analog/proportional on the x and y axes for finer control.

Figure 14:
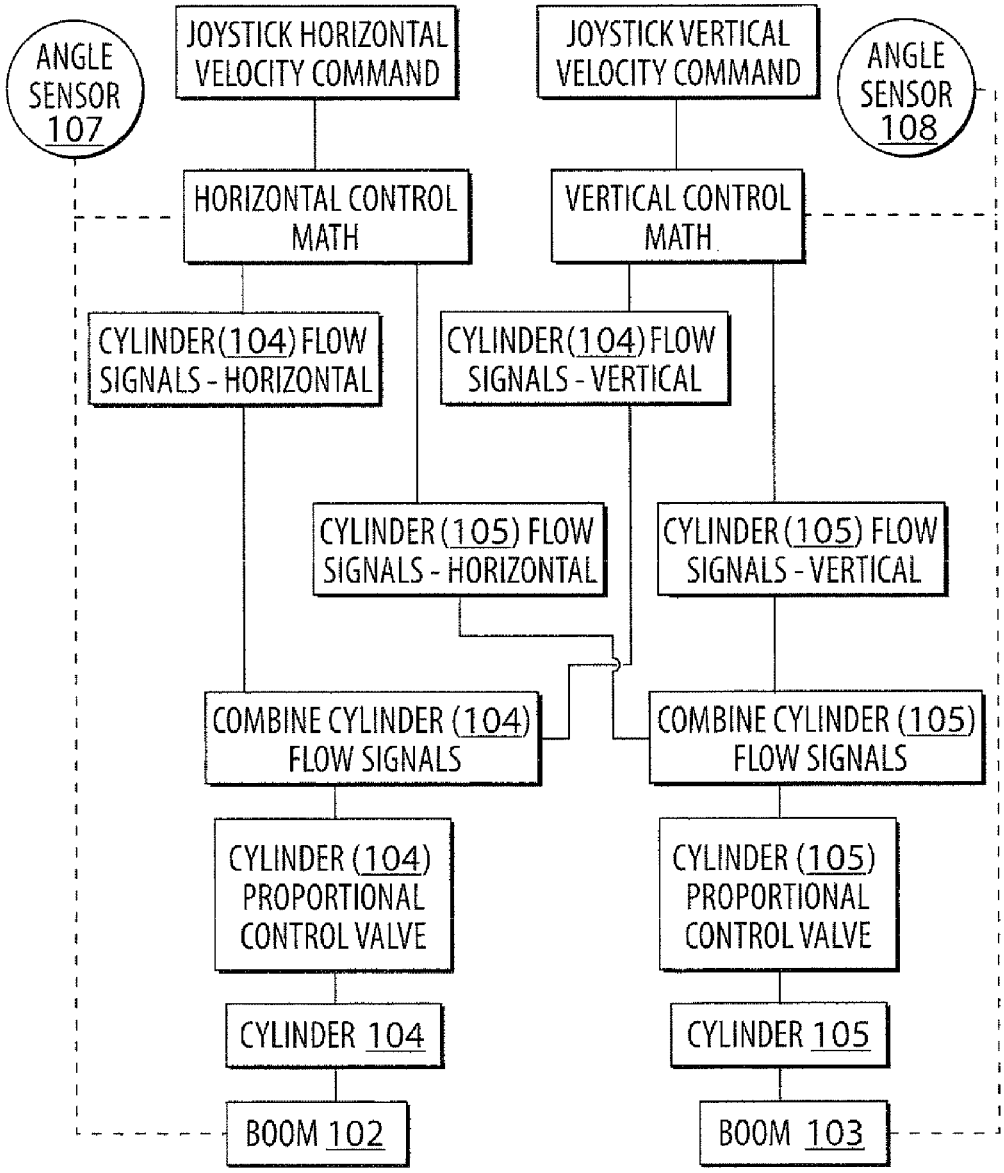

FIGS. 13 and 14 show a diagrammatic flowchart of the preferred controls for manipulator 99.

Horizontal motion of the tong requires movement of both boom 102 and boom 103, accomplished via linear actuators 104 and 105. The required output velocity signals to each of linear actuators 104 and 105 are computed in the PLC 112 in order to achieve the desired horizontal command velocity from the x-axis of joystick 111.

Similarly, vertical motion of the tong requires movement of both boom 102 and boom 103, accomplished via linear actuators 104 and 105. The required output velocity signals to each of linear actuators 104 and 105 are computed in the PLC 112 in order to achieve the desired vertical command velocity from the y-axis of joystick 111.

The control system is also capable of combined horizontal/vertical motion control. In this case the required velocity signals for linear actuators 105 and 105 are computed separately for each axis (horizontal/vertical) and then superimposed for output to the actuators.

A feedback loop may optionally be employed in which, for each motion axis (horizontal/vertical) the actual velocity (rate of change of position over time) is periodically compared to the joystick velocity command and any necessary adjustment made. This feedback is particularly useful when the operator commands pure horizontal or pure vertical motion at the joystick. If the operator commands a pure vertical motion, for example, any inadvertent deviation from the vertical axis will be detected and adjustments made to the velocity signals to linear actuators 104 and 105 to tune it back to a pure vertical motion.

Output to linear actuator(s) 106 is controlled by the PLC 112 to keep the tong level at all times according to input from angle sensor 109.

The control system may also have capability for automated travel to pre-defined locations such as well center, mousehole and parked position. When the operator commands automated travel to a desired pre-defined target location, the control system control acceleration, travel velocity, deceleration and landing speed for both horizontal and vertical axes to achieve optimum travel to the target, with minimum elapsed time and smooth, controlled motion.

It can be seen that the control system enables efficient Cartesian motion control (horizontal/vertical) of a polar (pivoting booms) mechanism, which has mechanical and operational advantages.

Figure 18:
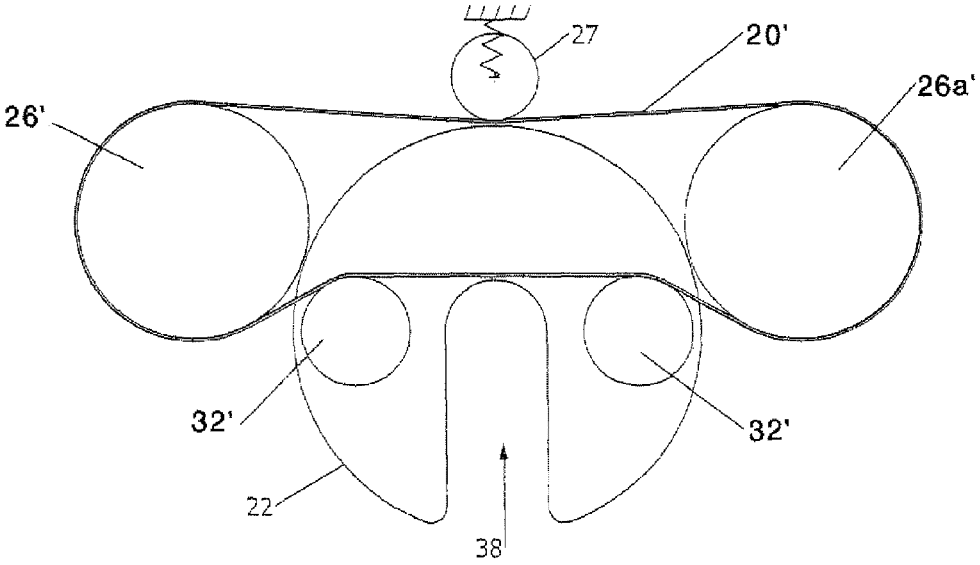
FIGS. 18 and 19 are in diagrammatic plan view, a further exemplary embodiment of the nested transmission of the tong, showing the use, by way of example, of two stator sprockets, at least one of which is driven, having a serpentine member therearound and reaved over a pair of rotor sprockets on the throated rotor, the pair of rotor sprockets having a synchronizer therearound, the rotor sprockets driving a coupling mechanism coupling the power transfer from the serpentine member to gripper actuators on the rotor which articulate grippers at the rotor axis of rotation.
Figure 19:
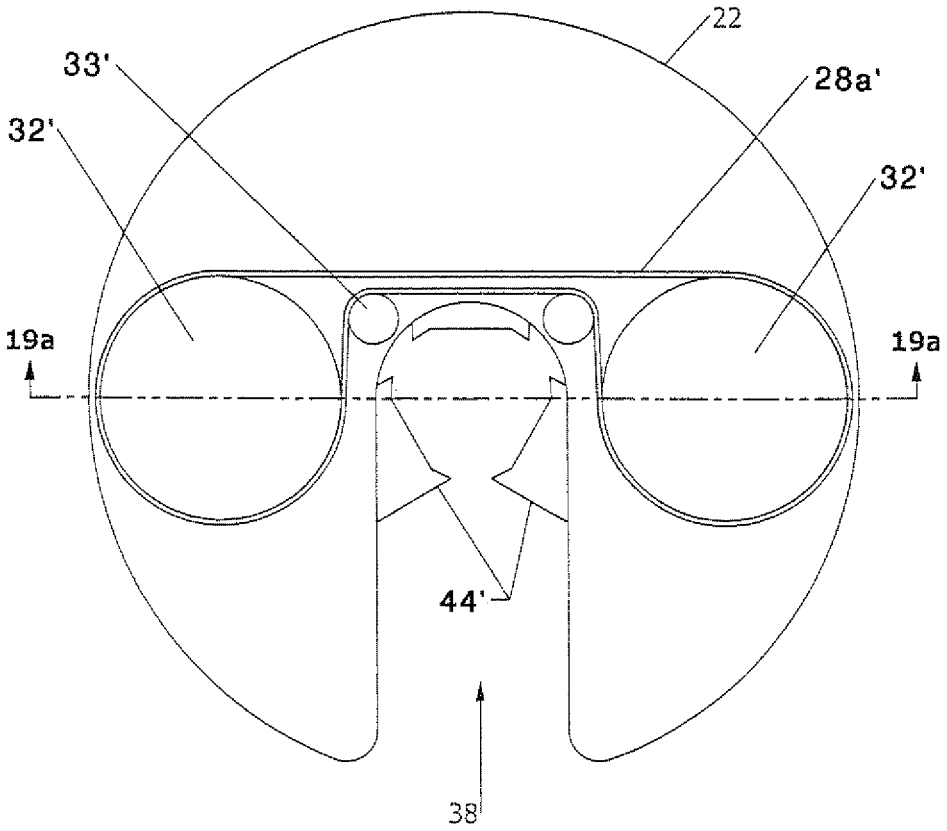

The alternative embodiments of FIGS. 18 and 19, which are not intended to be limiting, but which are, rather, intended to exemplify that the serpentine drive and the separate synchronization by a synchronizer, which allows the free unencumbered rotation of the rotor without blocking of the rotor's throat, may be accomplished using various geometric arrangements of serpentine drive and synchronization as part of a nested transmission which may for example employ a plurality of drive and idler sprockets.

In particular, in FIG. 18, serpentine drive belt 20' is driven by at least one serpentine drive motor which may for example be at least one hydraulic motor. The serpentine drive motor drives at least one drive sprocket **26*a*' which, as before, provide a secondary drive via a plurality of rotor or satellite sprockets 32' on rotor 22, and also drives a synchronizer between sprockets 32' and a coupling such as pumps or generators, or a mechanical mechanism powering gripper actuators and corresponding grippers 44', or directly acting on grippers 44', on the rotor 22. As illustrated by way of example, a first drive stator sprocket 26*a*' rotates serpentine drive belt 20' about a second stator sprocket which may be a second drive sprocket 26*a*' or an idler sprocket 26' mounted to drive section 10. A tensioner 27 such as a tensioning idler sprocket, which may be considered a third stator sprocket, may be mounted to frame 60 so as to be resiliently biased against serpentine drive belt 20' to tension the drive belt. A pair of satellite or rotor sprockets 32' are mounted on the rotor 22. As seen in FIG. 18**, the first and second stator sprockets are mounted on substantially opposite sides of the rotor. As the term is used herein, the first and second stator sprockets are arrayed substantially around the rotor. Third, fourth, etc stator sprockets would thus not have to be on one side or the other of the rotor, but would form part of the array of stator sprockets arrayed substantially around the rotor.

Figure 4:
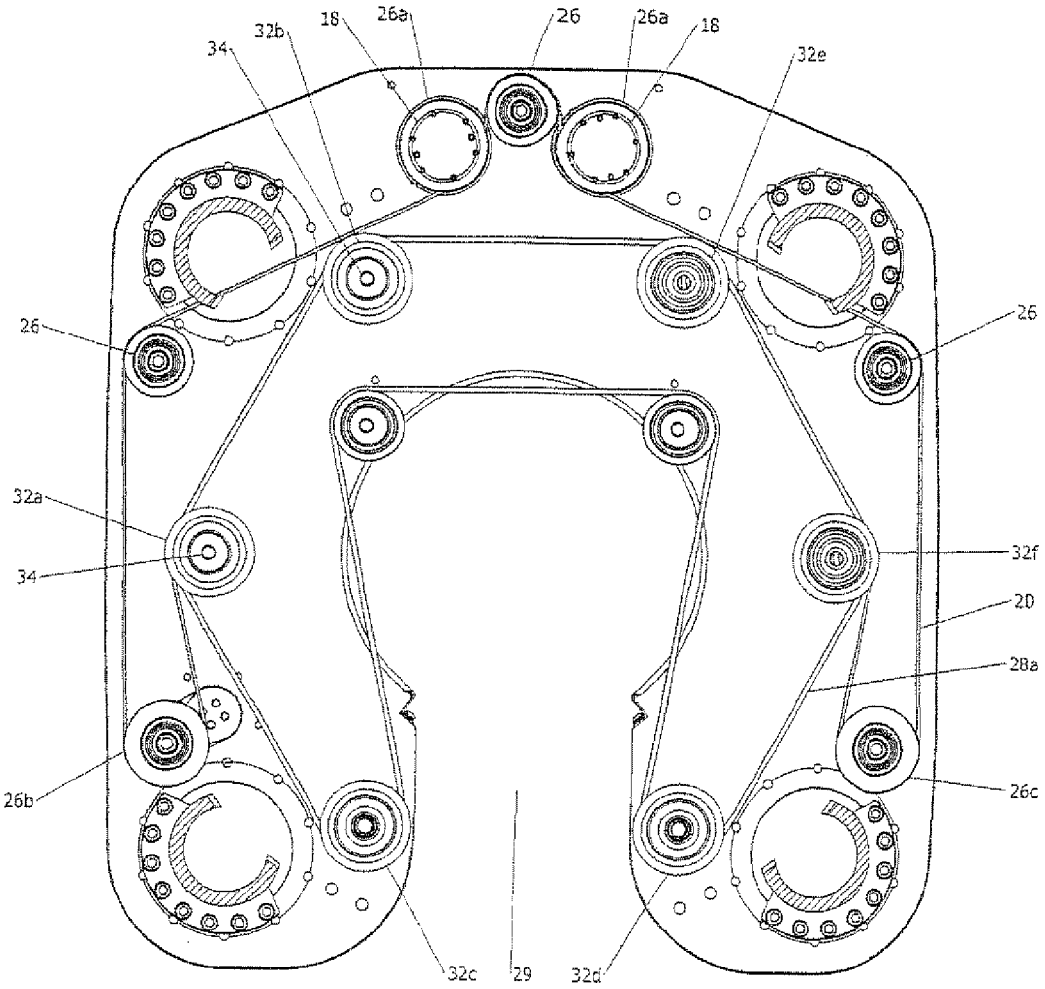
FIG. 4 is a plan view of the serpentine and synchronization belt drive system of FIG. 3 along line 4-4 in FIG. 5.
Figure 5:
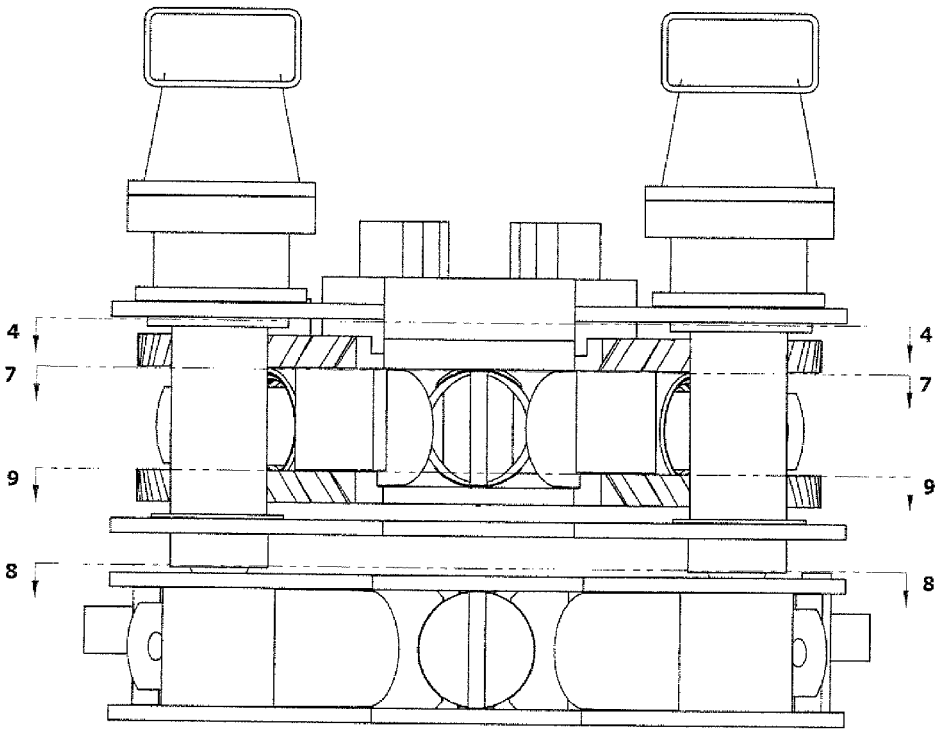
FIG. 5 is, in front elevation view, the power tong of FIG. 1 with the thread compensator cylinders retracted.
Figure 5A:
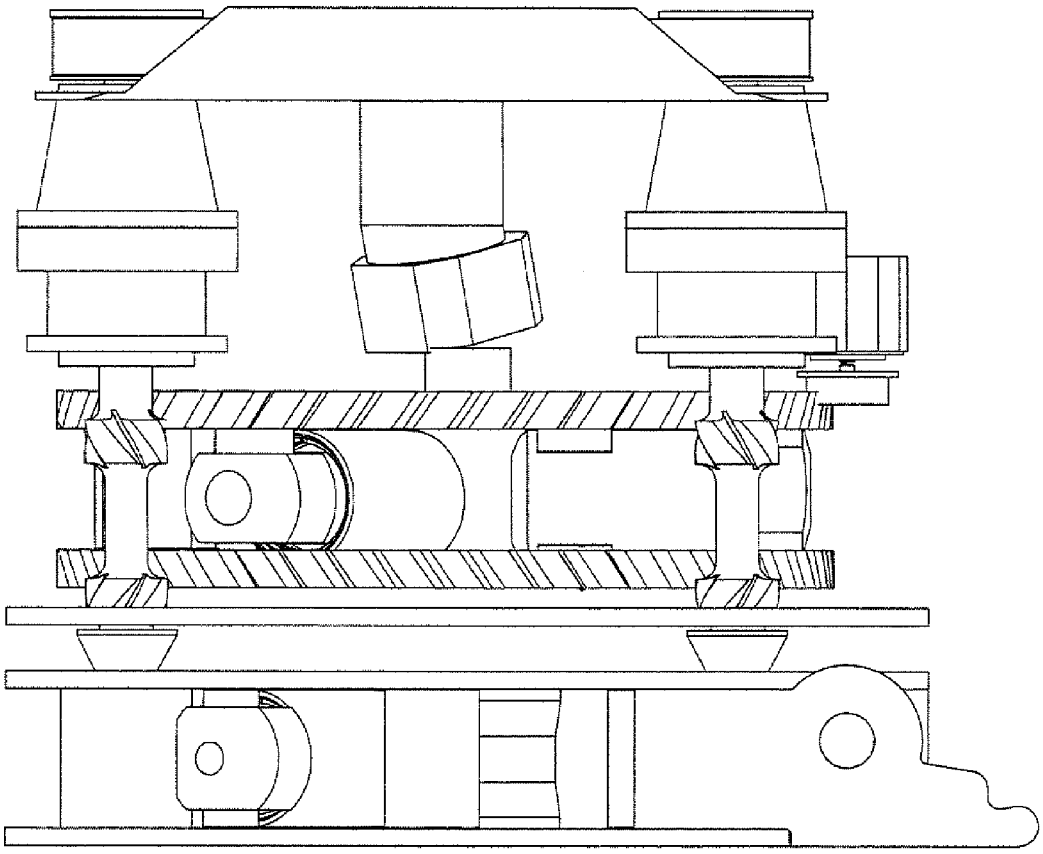
FIG. 5*a* is, in side elevation view, the power tong of FIG. 5 with the thread compensator cylinders extended.
Figure 5B:
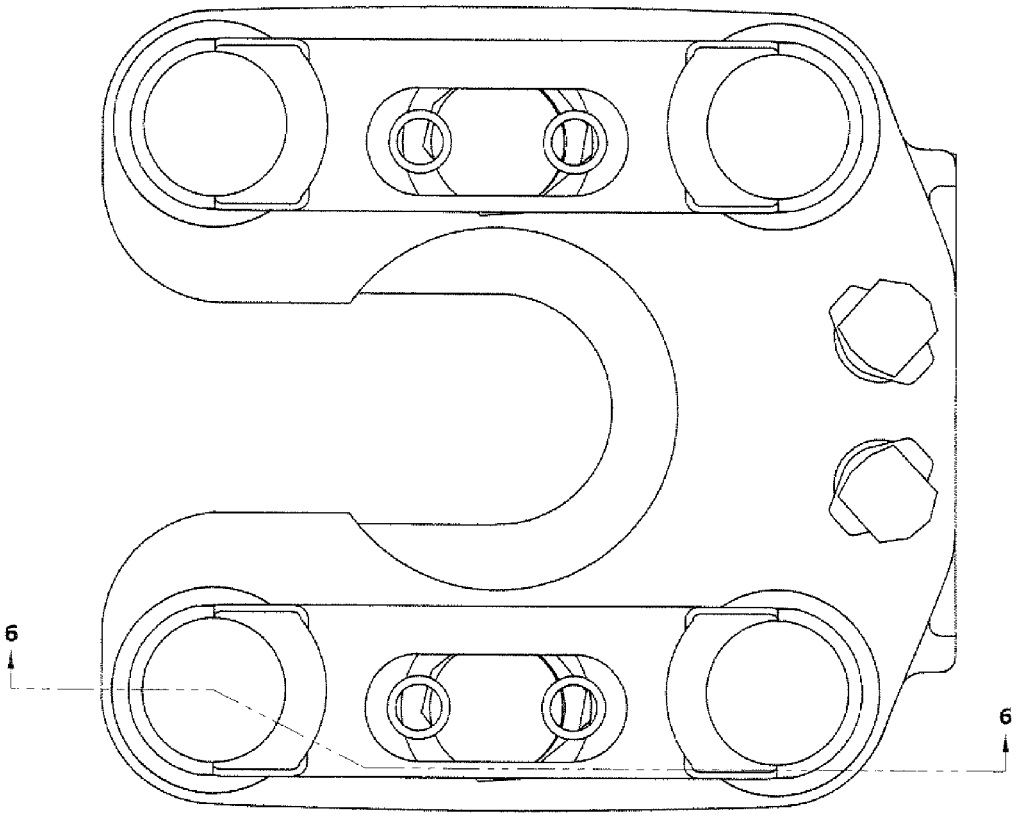
FIG. 5*b* is a plan view of the power tong of FIG. 5.

Synchronization belt **28*a*' is, as before, mounted on rotor 22 and passes around satellite or rotor sprockets 32' and idler sprockets 33' so as to maintain rotation of the individual rotor sprockets 32' as they pass sequentially through the serpentine gap 29 (such as seen in FIG. 4). Synchronization belt 28*a*' synchronizes the speed and phase of the rotation of each of the rotor sprockets 32' to allow each of them in turn to re-engage the serpentine drive belt 20' after they are rotated on rotor 22 out of contact with drive belt 20' across the gap between drive sprockets 26*a*' by the action of rotor 22 rotating relative to the frame on which the main drive is mounted, ie the main drive section 10**.

As rotor 22 rotates, sequentially at least one satellite sprocket 32' will detach from engagement with drive belt 20' and rotate across the gap between sprockets **26*a*' and 26'. As that sprocket crosses the gap it is disengaged from drive belt 20', during which time at least one remaining rotor sprocket remains engaged with drive belt 20'. All sprockets 32' continue to rotate synchronously as driven simultaneously by synchronization belt 28*a*' The process repeats in succession for each rotor sprocket 32' as each of the rotor sprockets 32' passes across the gap between sprockets 26' and 26*a*'**.

Figure 18A:
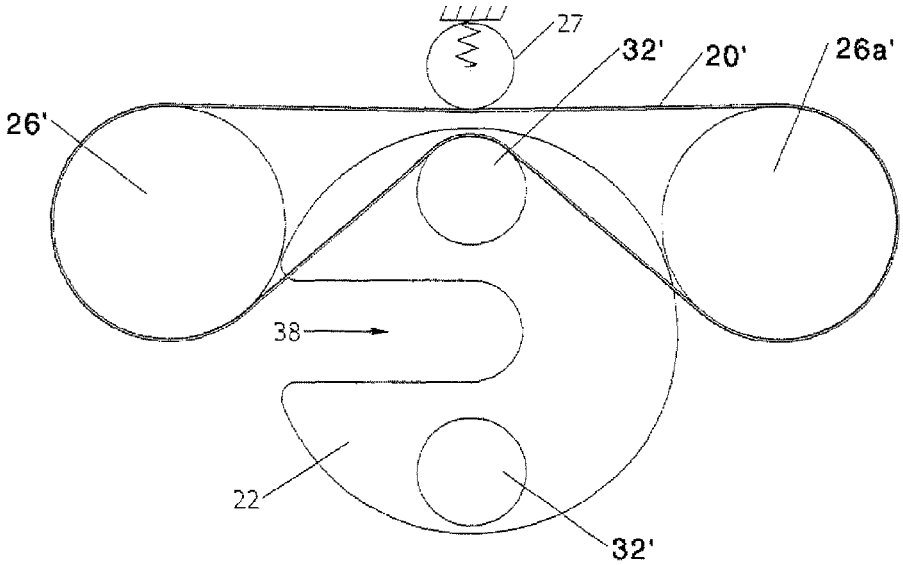
FIG. 18*a* is the view of FIG. 18 wherein the rotor has rotated 90 degrees.

The rotor sprockets 32' drive for example one or more on-board generators and/or one or more on-board hydraulic pumps (not shown in FIGS. 18 and 19). Synchronization belt **28*a*' may connect the lower or upper portions of the rotor sprockets 32', with the serpentine drive belt 20' then connecting the upper or lower portions of the rotor sprockets 32' respectively. Thus as rotor 22 rotates about axis of rotation A even though serpentine drive belt 20' cannot extend across the opening throat 38 because such a blockage would restrict selective positioning of the pipe 8 along the slot into the tong, serpentine drive belt 20' wraps around or reaves so as to remain at all times in contact with at least one of rotor sprockets 32'. Drive sprockets 26*a*' are mounted to, so as to for example depend downwardly from, main drive section 10. As seen in FIG. 18*a*, the deflection of serpentine drive belt 20' by the rotation of rotor sprockets 32' provides for continual contact between serpentine drive belt 20' and a minimum of one of the rotor sprockets as the rotor 22 rotates relative to the main drive section 10, wherein the deflection of serpentine drive belt 20' tensions the portion of drive belt 20' where it contacts tensioner 27. Upon return of the rotor sprockets to the position of FIG. 18, tensioner 27 takes up the slack in the drive belt 20'**.

Tensioner 27 may be an idler sprocket, which may be spring-mounted or otherwise have a resilient biasing means to maintain minimum required tension in the serpentine drive belt 20' regardless of the rotational position of rotor 22. This is advantageous as there is a small variation in the length of the path of the serpentine drive belt 20' as rotor 22 rotates about axis A. Alternatively, other stator sprockets or rotor sprockets may be resiliently biased to maintain tension in the serpentine drive belt 20'.

Although in the illustrations, the synchronizer of the rotor sprockets 32' is shown as a belt, one skilled in the art would appreciate that other forms of synchronization would also work and are intended to fall within the intended meaning of the word synchronizer. For example a synchronizer may also include the use of gears, a flexible shaft, a rigid shaft with right-angle gearboxes, a hydraulic or other fluid system to synchronize the movement of the rotor sprockets.

The forms of coupling are also not intended to be limited to only those illustrated or discussed elsewhere herein, as for example the coupling may include a mechanical coupling or linkage between the rotor sprockets and grippers. For example, the rotor sprockets may directly or indirectly drive worm gear reducers which drive screws which grip pipe 8, in which case the serpentine, such as drive belt 20', would operate to directly cause the screws to clamp or unclamp the tubular. The screws when tightening on to a tubular would, for example, be turned until they come to a stop against the tubular joint, at which time the serpentine would stop turning as the serpentine drive stalls and thereafter would turn to match the rotation of the rotor in either direction to maintain approximately constant tension on the serpentine drive belt.

Figure 19A:
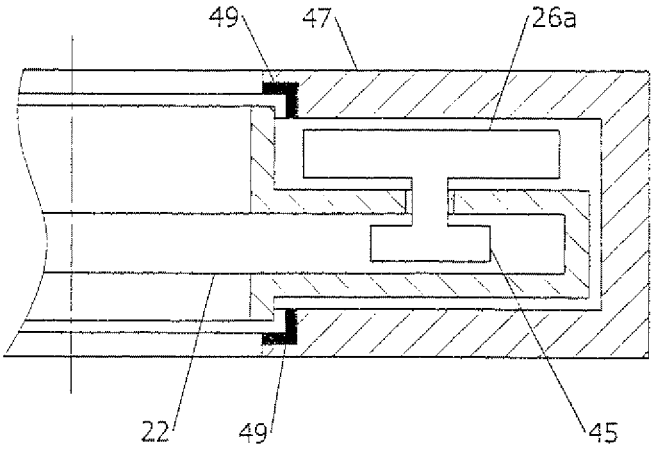
FIG. 19*a* is a partially cut-away section view along line 19*a*-19*a* in FIG. 19 showing one rotor (satellite) sprocket driving, by way of example, a pump and/or generator part of the power or energy transfer coupling between the serpentine member and the gripper actuators.

As seen in FIG. 19*a*, rotor 22, the rotor sprockets 32', and one or more energy coupling 45 may be mounted within a rotary jaw frame 47 on, for example, bushings 49. Energy couplings 45 couple the energy being transmitted from the serpentine to the rotor sprockets 32', and couples the energy to the grippers 44' or gripper actuators (which in turn actuate the grippers). As stated above, energy couplings 45 may include pumps, generators, or mechanical drives such as direct mechanical linkages, but may also include the use of energy storage such as, without intending to be limiting, gas accumulators, batteries, capacitors, flywheels, which may then power actuation of the grippers when needed.

The serpentine drive belt 20 or 20' although illustrated as a belt, is intended to include within the meaning of the word serpentine, and as would be known to one skilled in the art, any suitable flexible member, for instance, a belt or chain or cable, with or without teeth to engage the stator and rotor sprockets, or other flexible or deformable member for transferring mechanical energy from the stator sprockets to the rotor sprockets.

The grip or grippers 44 or 44' may, although discussed and illustrated herein as being hydraulically actuated, include as within the intended meaning of the word grip or gripper; mechanical, fluid such as hydraulic, or electric actuation, with the corresponding actuators including such as screws, pistons, wedges, eccentrics or cams.

The reference herein to sprockets such as the stator or rotor sprockets may, as would be known to one skilled in the art, include, and are intended to include the use of pulleys, sheaves, wheels, etc.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A power tong comprising:

a rotor supported for rotation about an axis relative to a drive section, the rotor having a first slot extending from a throat on a periphery of the rotor to an opening at the axis;

a first set of grippers carried on the rotor, the first set of grippers connected to be powered by energy supplied by one or more generators carried on the rotor;

a first drive cooperating between the drive section and the rotor, the first drive operable to drive the rotation of the rotor about the axis;

a drive loop arranged to follow a path on the drive section, the drive section and path configured to provide a gap such that when the rotor is rotated to a first angle such that the throat and the gap overlap, the drive section and drive loop permit passage of a tubular oriented parallel to the axis through the gap into the first slot;

a second drive operable to drive circulation of the drive loop;

a plurality of rotational drive elements mounted for rotation on the rotor and angularly spaced apart around the rotor, each of the plurality of rotational drive elements arranged to contact and be driven in rotation by a surface of the drive loop for a range of angles of the rotor, each of the plurality of rotational drive elements coupled to drive at least one of the generators such that the one or more generators are operable to generate power at any angle of the rotor by driving the drive loop whether or not the rotor is being rotated by the first drive.

2. A power tong according to claim 1 comprising a backup jaw coupled to the drive section, the backup jaw formed to provide a second slot oriented and dimensioned such that with the rotor in the first angle the first and second slots are aligned such that the tubular can be passed through the first and second slots to the axis, the backup jaw including a second set of grippers actuable to grip the tubular when the tubular is aligned along the axis.

3. A power tong according to claim 2 wherein the first and second sets of grippers are spaced apart from one another to receive a threaded joint of the tubular between them and the power tong comprises a spacing adjuster for adjusting spacing between the first and second sets of grippers as the joint is said threaded or unthreaded.

4. A power tong according to claim 1 wherein the first set of grippers comprises a plurality of linear actuators coupled to move a plurality of jaws radially against a tubular located in the opening on the axis.

5. A power tong according to claim 4 wherein the plurality of linear actuators includes first and second linear actuators extending generally radially on the rotor and respectively located on opposing sides of the slot wherein radially inner ends of the first and second linear actuators are constrained to follow arcuate paths by links coupled between the inner ends of the actuators and corresponding pivots on the rotor.

6. A power tong according to claim 5 wherein the first and second actuators project into the slot at radially inward ends of the arcuate paths.

7. A power tong according to claim 5 wherein the linear actuators comprise cylinders and rod-ends of the cylinders are arranged to extend radially outwardly relative to the rotor.

8. A power tong according to claim 1 wherein the generators are coupled to drive the first set of grippers by a coupling that includes energy storage from the group comprising at least one gas accumulator, at least one battery, at least one capacitor, at least one flywheel.

9. A power tong according to claim 1 wherein the drive loop passes around a plurality of rollers and comprises a tensioner cooperating with the drive loop to maintain tension in the drive loop as the rotor rotates.

10. A power tong according to claim 1 wherein the drive loop comprises at least one flexible member selected from the group consisting of belt. chain, and cable.

11. A power tong according to claim 1 wherein the angular spacing of the rotational drive elements is greater than an angular extent of the gap such that when the rotor is being rotated, the rotational drive elements pass through the gap one at a time.

12. A power tong according to claim 1 wherein the one or more generators comprise one or more of: a) one or more electrical generators; and b) one or more hydraulic pumps.

13. A power tong according to claim 1 wherein the at least one generator comprises a hydraulic pump.

14. A power tong according to claim 13 comprising a rapid advance flow path connected to supply hydraulic fluid pressurized by the hydraulic pump to the first set of grippers at a lower pressure, an intensifier connected to increase a pressure of the hydraulic fluid and a high-pressure flow path connected to supply hydraulic fluid pressurized by the intensifier to the first set of grippers.

15. A power tong according to claim 1 wherein the at least one generator comprises both a hydraulic pump and an electrical generator.

16. A power tong according to claim 15 comprising a programmable logic controller and a wireless communication link on the rotor wherein the electrical generator is connected to supply power to the programmable logic controller and the wireless communication link and the programmable logic controller is connected to control operation of the first set of grippers.

17. A power tong according to claim 1 comprising an idler on the rotor, the idler at an angular position between two of the plurality of rotational drive elements and arranged to contact the surface of the drive loop for some angles of the rotor.

18. A power tong comprising:

a rotor supported for rotation about an axis relative to a drive section, the rotor having a first slot extending from a throat on a periphery of the rotor to an opening at the axis;

a first set of grippers carried on the rotor, the first set of grippers connected to be powered by energy supplied by one or more power sources carried on the rotor;

a first drive cooperating between the drive section and the rotor, the first drive operable to drive the rotation of the rotor about the axis;

a plurality of drive elements mounted for rotation on the rotor about corresponding axes, the plurality of rotational drive elements angularly spaced apart around the rotor, each of the plurality of rotational drive elements arranged on the rotor such that the rotational drive element contacts a movable surface supported on the drive section for a range of angles of the rotor;

a second drive connected to drive the movable surface independently of the rotor such that the movable surface drives rotation of those of the plurality of rotational drive elements in contact with the movable surface when the movable surface is being driven by the second drive;

wherein the movable surface is interrupted by a gap such that when the rotor is rotated to a first angle such that the throat overlaps with the gap, the drive section and movable surface permit passage of a tubular oriented parallel to the axis through the gap into the first slot;

each of the plurality of rotational drive elements coupled to drive at least one of the power sources such that the one or more power sources are operable to generate power at any angle of the rotor by driving the movable surface whether or not the rotor is being rotated by the first drive.

19. A power tong according to claim 18 wherein the movable surface comprises a surface of a drive loop.

20. A power tong according to claim 19 wherein the movable surface comprises an outside surface of the drive loop.

21. A power tong according to claim 19 wherein the drive loop comprises a belt, chain or cable.

22. A power tong according to claim 18 where each one of the rotatable drive elements is in contact with the movable surface for at least180 degrees of rotation of the rotor.

23. A power tong according to claim 18 wherein the at least one power source comprises at least one hydraulic pump and at least one electrical generator.

24. A power tong according to claim 18 wherein the at least one power source includes a power source selected from an electrical generator and a hydraulic pump.

25. A power tong according to claim 18 comprising an idler element on the rotor, the idler element angularly spaced between two of the plurality of rotational drive elements and arranged to contact the movable surface for at least some angles of the rotor.

* * * * *